US011473228B2

(12) United States Patent
Kamihira

(10) Patent No.: US 11,473,228 B2
(45) Date of Patent: Oct. 18, 2022

(54) NON-TRANSITORY COMPUTER-READABLE MEDIUM AND EMBROIDERY DATA GENERATION METHOD

(71) Applicant: BROTHER KOGYO KABUSHIKI KAISHA, Nagoya (JP)

(72) Inventor: Yuta Kamihira, Ama-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 119 days.

(21) Appl. No.: 17/021,270

(22) Filed: Sep. 15, 2020

(65) Prior Publication Data

US 2020/0407897 A1 Dec. 31, 2020

Related U.S. Application Data

(63) Continuation of application No. PCT/JP2019/008558, filed on Mar. 5, 2019.

(30) Foreign Application Priority Data

Mar. 16, 2018 (JP) ..... JP2018-049673

(51) Int. Cl.
*D05B 19/08* (2006.01)
*D05B 19/12* (2006.01)

(52) U.S. Cl.
CPC ..... *D05B 19/08* (2013.01); *D05B 19/12* (2013.01); *D05D 2305/36* (2013.01)

(58) Field of Classification Search
CPC ..... D05B 19/08; D05B 19/10; D05B 19/12; D05D 2305/36; D05C 5/02
See application file for complete search history.

(56) References Cited

U.S. PATENT DOCUMENTS 5,855,176 A 1/1999 Takenoya et al.
6,256,551 B1 * 7/2001 Muto ..... D05B 19/10 112/102.5

(Continued)

FOREIGN PATENT DOCUMENTS

JP H11-164974 A 6/1999
JP 2000-024350 A 1/2000

(Continued)

OTHER PUBLICATIONS

May 28, 2019 International Search Report issued in International Patent Application No. PCT/JP2019/008558.

(Continued)

*Primary Examiner* — Nathan E Durham
(74) *Attorney, Agent, or Firm* — Oliff PLC

(57) ABSTRACT

A non-transitory computer-readable medium stores computer-readable instructions, when executed by a computer, causing the computer to execute a process. The process and a method of generating embroidery data each includes: obtaining a pattern to be sewn on a workpiece by a sewing machine; obtaining a size of a sewing area to be set inside an embroidery hoop attachable to the sewing machine; setting a virtual arrangement of a plurality of the sewing areas relative to the workpiece; setting a virtual arrangement of the pattern relative to the workpiece; changing a relative position of the sewing areas; and generating embroidery data including needle drop data, the needle drop data representing a plurality of coordinates of needle drop points to form a plurality of stitches for the pattern located in each of the sewing areas in the relative position changed.

10 Claims, 10 Drawing Sheets

(56) References Cited

U.S. PATENT DOCUMENTS

| | | | |
|---|---|---|---|
| 2007/0213865 | A1 | 9/2007 | Mizuno |
| 2018/0298535 | A1 | 10/2018 | Kamihira et al. |

FOREIGN PATENT DOCUMENTS

| | | | |
|---|---|---|---|
| JP | 2004-180993 | A | 7/2004 |
| JP | 2007-275549 | A | 10/2007 |
| JP | 2017-113448 | A | 6/2017 |

OTHER PUBLICATIONS

Sep. 22, 2020 International Preliminary Report on Patentability issued in International Patent Application No. PCT/JP2019/008558.

* cited by examiner

| N \ M | 1 | 2 |
|---|---|---|
| 1 | X1 | Y1 |
| 2 | Y1 | X1 |

49

| N \ M | 1 | 2 |
|---|---|---|
| 1 | X1 | Y1 |
| 2 | Y1 | X1 |

49

NON-TRANSITORY COMPUTER-READABLE MEDIUM AND EMBROIDERY DATA GENERATION METHOD

CROSS-REFERENCE TO RELATED APPLICATION

This is a continuation application of International Application No. PCT/JP2019/008558 filed on Mar. 5, 2019 which claims priority from Japanese Patent Application No. 2018-049673 filed on Mar. 16, 2018. The entire contents of the earlier applications are incorporated herein by reference.

TECHNICAL FIELD

Aspects of the disclosure relate to a non-transitory computer-readable medium and an embroidery data generation method.

BACKGROUND

Sewing machines capable of embroidering use embroidery hoops for holding a workpiece to embroider within a sewing area to be set inside an embroidery hoop. The size of sewing area varies according to the type of embroidery hoop. A known sewing machine splits an embroidery pattern, which is larger in size than the sewing area, into sub patterns which are each smaller than the sewing area, and stores embroidery data corresponding to the sub patterns. The sewing machine sews such an embroidery pattern larger than the sewing area by sequentially sewing the sub patterns in accordance with embroidery data. Every time a sub pattern is embroidered, a user changes a position of the workpiece to be held by the embroidery hoop relative thereto. The sewing machine includes an imaging device to capture images of signs placed on a workpiece before and after changing a position of the workpiece to be held by the embroidery hoop. The sewing machine extracts features from the images of the signs and adjust positions of sub patterns based on the extracted features.

SUMMARY

Aspects of the disclosure provide a non-transitory computer-readable medium and a method of generating embroidery data, wherein, when an embroidery pattern larger than a sewing area is split into the sub patterns each smaller than the sewing area, an arrangement of sub patterns relative to sewing areas is set with an enhanced flexibility.

According to a first aspect of the disclosure, a non-transitory computer-readable medium stores computer-readable instructions, when executed by a computer, causing the computer to execute a process. The process includes: obtaining a pattern to be sewn on a workpiece by a sewing machine; obtaining a size of a sewing area to be set inside an embroidery hoop attachable to the sewing machine; setting a virtual arrangement of a plurality of the sewing areas relative to the workpiece; setting a virtual arrangement of the pattern relative to the workpiece; changing a relative position of the sewing areas; and generating embroidery data including needle drop data, the needle drop data representing a plurality of coordinates of needle drop points to form a plurality of stitches for the pattern located in each of the sewing areas in the relative position changed In a case where an embroidery pattern larger than the sewing area is split into sub patterns each smaller than the sewing area, the computer can change the relative position of the sewing areas when the computer executes a computer-readable instruction stored in the non-transitory computer-readable medium according to the first aspect of the disclosure. The computer has a greater flexibility in setting an arrangement of sub patterns relative to sewing areas than a known apparatus which cannot change a relative position of sewing areas.

According to a second aspect of the disclosure, a method of generating embroidery data includes: obtaining a pattern to be sewn on a workpiece by a sewing machine; obtaining a size of a sewing area to be set inside an embroidery hoop attachable to the sewing machine; setting a virtual arrangement of a plurality of the sewing areas relative to the workpiece; setting a virtual arrangement of the pattern relative to the workpiece; changing a relative position of the sewing areas; and generating embroidery data including needle drop data, the needle drop data representing a plurality of coordinates of needle drop points to form a plurality of stitches for the pattern located in each of the sewing areas in the relative position changed.

The method of generating embroidery data according to the second aspect of the disclosure provides effects similar to those of the non-transitory computer-readable medium according to the first aspect of the disclosure.

DETAILED DESCRIPTION

Figure 1:
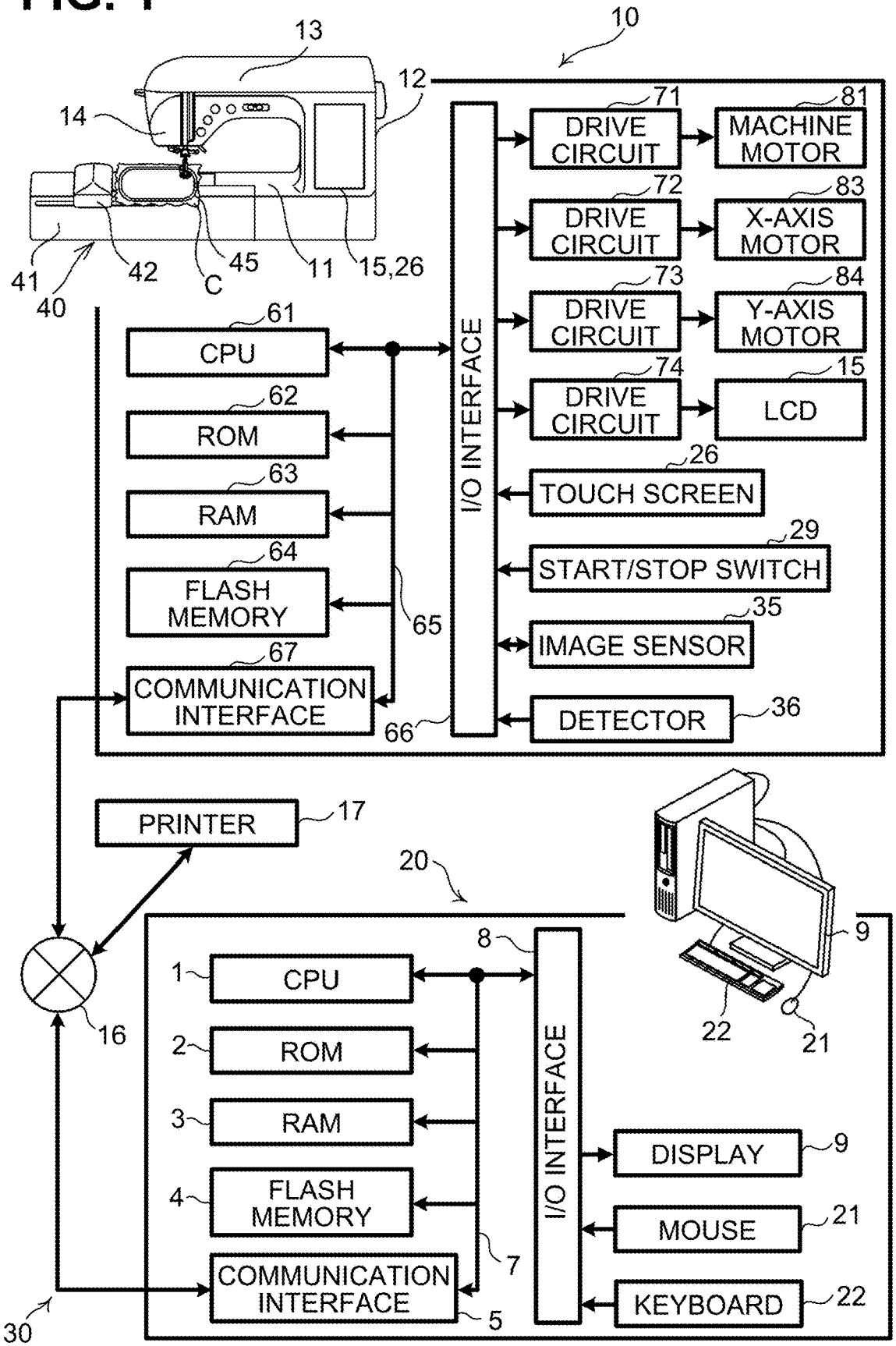
FIG. 1 illustrates a sewing system including a sewing machine, a printer, and an embroidery data generation apparatus according to aspects of the disclosure.

An embodiment is described with reference to the accompanying drawings. In the following description, image data to be processed by a computer may be simply referred to as an image. As illustrated in FIG. 1, a sewing system 30 includes a sewing machine 10, a printer 17, an embroidery data generation apparatus 20 (hereinafter referred to as an apparatus 20). The sewing machine 10 is capable of embroidering. The printer 17 executes printing in accordance with print data received via a network 16. The apparatus 20 is a known personal computer (PC) including a display 9, a mouse 21, and a keyboard 22.

<1. Physical Structure of Sewing Machine 10 and Embroidery Hoop 45>

As illustrated in FIG. 1, the sewing machine 10 includes a bed 11, an upright arm 12, a horizontal arm 13, a head 14, a movement mechanism 40, and an image sensor 35. The bed 11 is a base of the sewing machine 10 and extends in the left-right direction. The upright arm 12 extends upward from a right end of the bed 11. A liquid crystal display (LCD) 15 and a touch screen 26 are disposed at a front surface of the upright arm 12. The horizontal arm 13 faces the bed 11 and extends to the left from an upper end of the upright arm 12. The head 14 is connected to a left end of the horizontal arm 13. The head 14 includes a needle bar, a presser bar, and a needle bar drive mechanism. A needle is removably attached to a lower end of the needle bar. The image sensor 35 is capable of capturing images below the needle bar.

The movement mechanism 40 is configured to move a workpiece C held by an embroidery hoop 45 relative to the needle bar. The movement mechanism 40 includes a body case 41 and a carriage 42. For embroidering, a user attaches the embroidery hoop 45 to the carriage 42. A Y-axis movement mechanism included in the carriage 42 and an X-axis movement mechanism included in the body case 41 move the embroidery hoop 45 to a needle drop point on the XY coordinate system (an embroidery coordinate system) specified in the sewing machine 10. Along with the movement of the embroidery hoop 45, the needle attached to the needle bar and the shuttle mechanism cooperate to form an embroidery pattern on the workpiece C. The movement mechanism 40 is configured to support a selected one of attachable embroidery hoops including the embroidery hoop 45, which are different in size.

<2. Electrical Configuration of Sewing Machine 10>

Referring to FIG. 1, an electrical configuration of the sewing machine 10 and the apparatus 20 of the sewing system 30 is described. The sewing machine 10 includes a CPU 61, a ROM 62, a RAM 63, a flash memory 64, an input/output ("I/O") interface 66, and a communication interface 67. The CPU 61 is connected to the ROM 62, the RAM 63, the flash memory 64, the I/O interface 66, and the communication interface 67, via a bus 65. The I/O interface 66 is connected to drive circuits 71 to 74, the touch screen 26, a start/stop switch 29, the image sensor 35, and a detector 36. The detector 36 is configured to detect that an embroidery hoop 45 has been attached to the movement mechanism 40 and output detection result corresponding to the type of the detected embroidery hoop 45. The flash memory 64 stores various set values. The flash memory 64 stores embroidery data corresponding to each of embroidery patterns to be sewn by the sewing machine 10. The embroidery data includes needle drop data, a sewing order, and color data. The needle drop data indicates the coordinates of needle drop points to form stitches of an embroidery pattern. The color data indicates a color of thread to be used.

The drive circuit 71 is connected to a machine motor 81. The drive circuit 71 drives the machine motor 81 based on a control signal from the CPU 61. In response to the driven machine motor 81, the needle bar drive mechanism is driven via a shaft of the sewing machine 10 and the needle bar thus moves up and down. The drive circuit 72 is connected to an X-axis motor 83. The drive circuit 73 is connected to a Y-axis motor 84. The drive circuits 72, 73 drive the X-axis motor 83 and the Y-axis motor 84, respectively, based on a control signal from the CPU 61. In response to the driven X-axis motor 83 and Y-axis motor 84, the embroidery hoop 45 attached to the movement mechanism 40 moves in the left-right direction (X-axis direction) and the front-rear direction (Y-axis direction) by a movement corresponding to the control signal. The drive circuit 74 drives the LCD 15 to display an image on the LCD 15 based on a control signal from the CPU 61. The communication interface 67 connects the sewing machine 10 to a network 16. The CPU 61 is capable of sending and receiving data to and from an apparatus connected to the network 16, such as the apparatus 20, through the communication interface 67.

Operation of the sewing machine 10 is described. During embroidering using the embroidery hoop 45, the movement mechanism 40 moves the embroidery hoop 45 in the X-axis direction and the Y-axis direction, and the needle bar drive mechanism and the shuttle mechanism are driven accordingly. Thus, the needle attached to the needle bar is operated to sew an embroidery pattern on a workpiece C held by the embroidery hoop 45.

<3. Electrical Configuration of Device 20>

As illustrated in FIG. 1, the apparatus 20 includes a CPU 1, a ROM 2, a RAM 3, a flash memory 4, a communication interface 5, and an input/output ("I/O") interface 8. The CPU 1 controls the apparatus 20. The CPU 1 is connected to the ROM 2, the RAM 3, the flash memory 4, the communication interface 5, and the I/O interface 8, via a bus 7. The ROM 2 stores a boot program and a BIOS (basic input output system). The RAM 3 stores temporary data. The flash memory 4 stores various set values. The flash memory 4 may store embroidery data like the flash memory 64. The communication interface 5 is an interface through which to connect the apparatus 20 to the network 16. The CPU 1 is capable of sending and receiving data to and from an apparatus connected to the network 16, such as the sewing machine 10 and the printer 17, through the communication interface 5. The I/O interface 8 is connected to the display 9, the mouse 21, and the keyboard 22. The display 9 is a liquid crystal display. The mouse 21 and the keyboard 22 are used to input instructions.

<4. Process to be Executed in Sewing Machine 10>

Referring to FIGS. 2 to 8, a main process of the sewing machine 10 is described. In the main process of the sewing machine 10, embroidery data for sewing a pattern selected by the user and print data for printing a pattern to be sewn (or a print pattern) are generated. The main process is executed by a user inputting, to the sewing machine 10, an instruction to start an application for executing the main process after specifying a type of embroidery hoop to be used, an overlap condition which will be described later, an option of enabling or disabling an optimization process which will be described later, and a type of medium to be printed. The type of embroidery hoop is selected from embroidery hoops stored in the flash memory 64. On determining that the start of the main process has been instructed, the CPU 61 of the sewing machine 10 reads out an embroidery data generation program for executing the main process stored in the program storage area of the ROM 62, into the RAM 63. The CPU 61 executes the following steps based on the instructions included in the embroidery data generation program read out into the RAM 63. The flash memory 64 stores parameters required for executing the main process. Various data obtained during the main process are stored in the RAM 63 at appropriate times. The following steps in the main process, except for S21 for sewing process, may be executed in the apparatus 20, and the sewing process may be executed in the sewing machine 10 based on embroidery data generated in the apparatus 20.

Figure 3A:
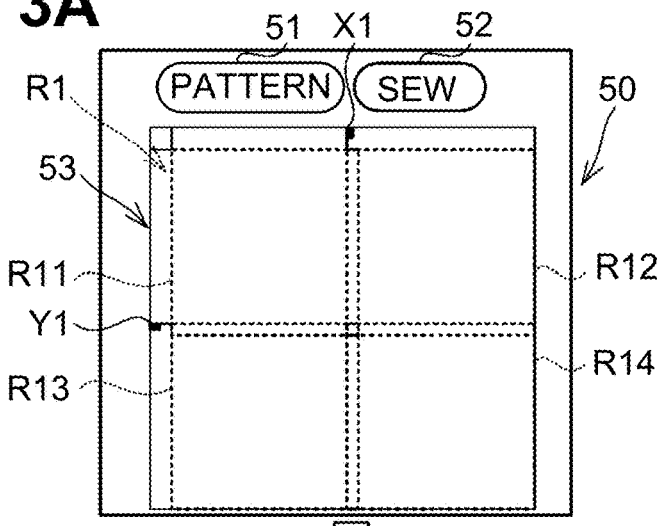
FIGS. 3A, 3B, 3C and 3D illustrate a process of generating embroidery data to sew stitches for a pattern in specific example 1.
Figure 3B:
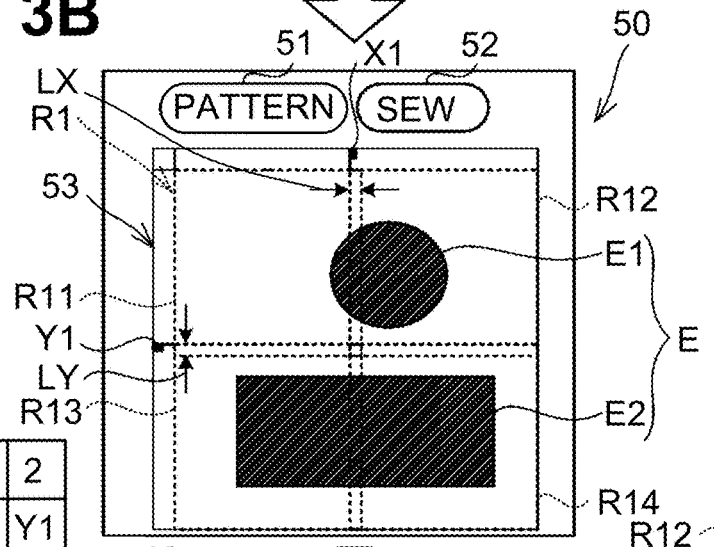
Figure 3C:
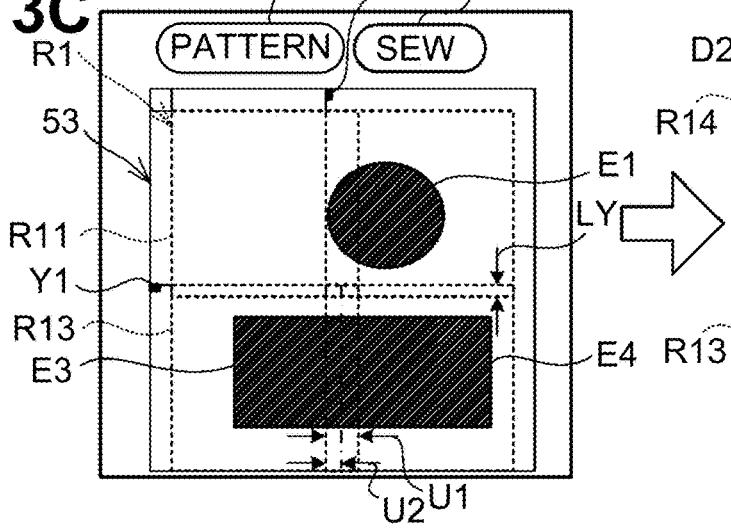
Figure 3D:
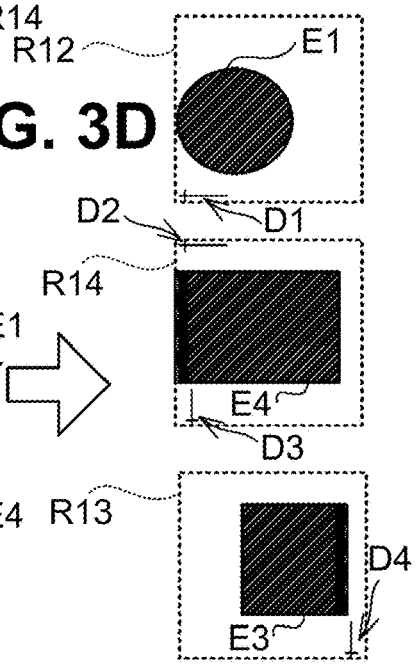
Figure 4A:
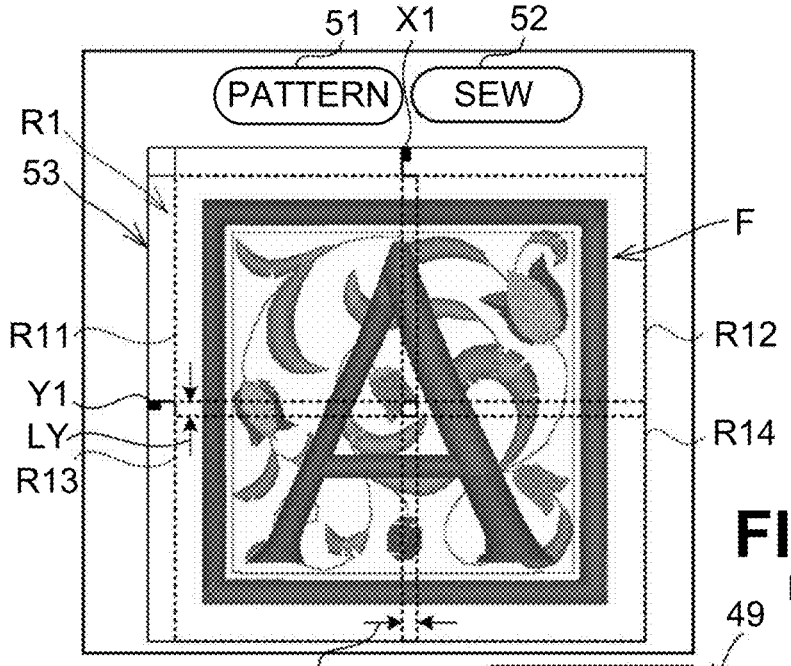
FIGS. 4A, 4B, and 4C illustrate a process of generating embroidery data to sew stitches for a pattern in specific example 2.
Figure 4B:
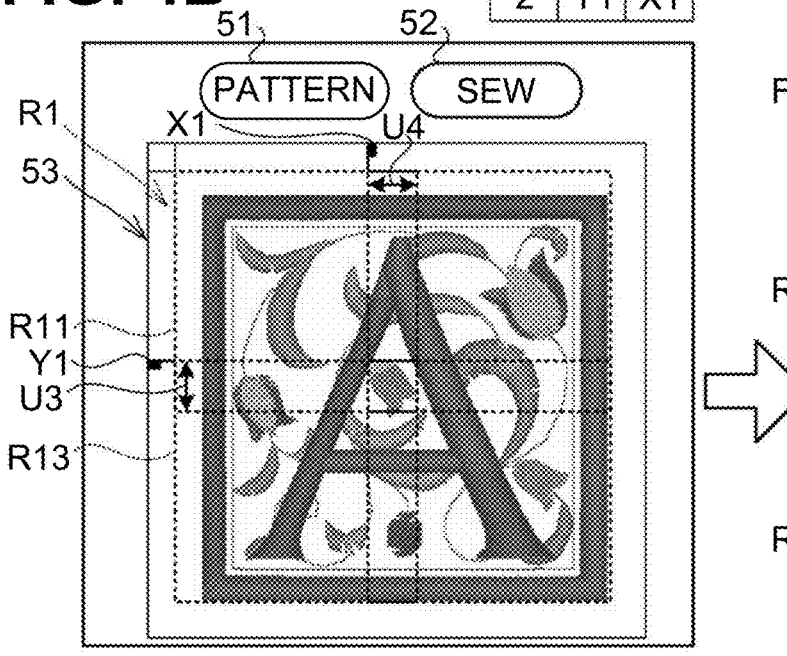
Figure 4C:
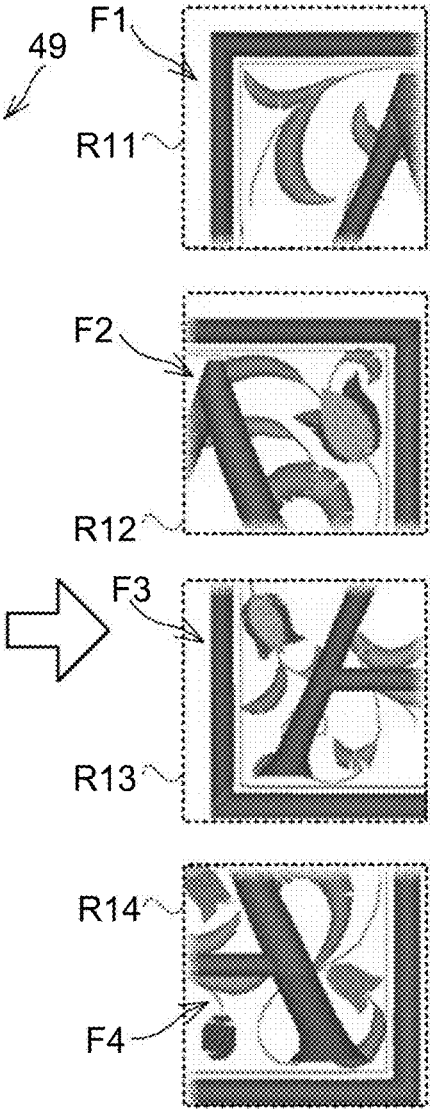
Figure 5A:
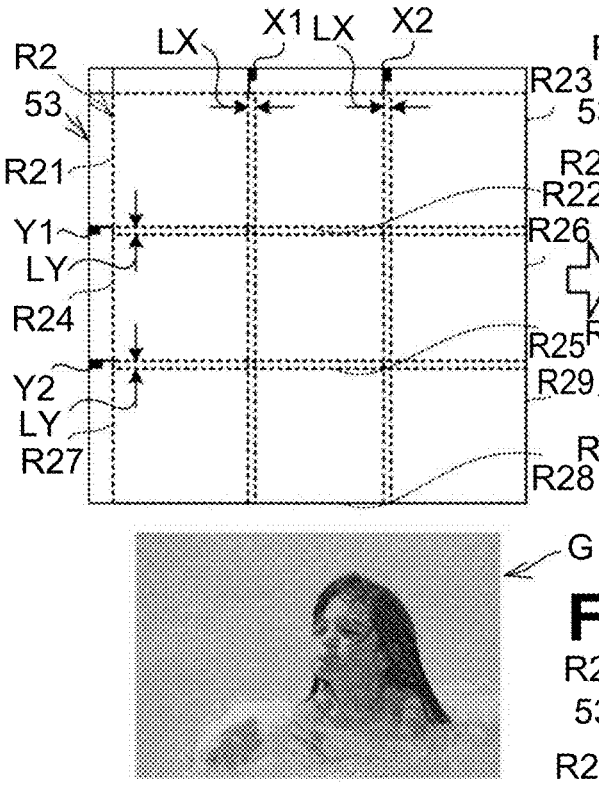
FIGS. 5A, 5B, 5C, 5D, and 5E illustrate a process of generating embroidery data to sew stitches for a pattern in specific example 3.
Figure 5B:
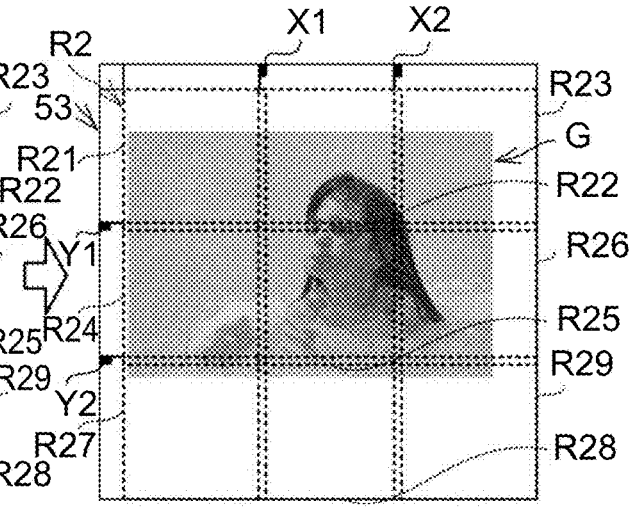

FIG. 3B illustrates specific example 1 where a pattern E to be sewn is virtually arranged relative to a workpiece C (a reference surface or sewing area). The pattern E includes patterns E1 and E2. The pattern E1 is a circular pattern to be sewn with tatami stitches of a single color thread. The pattern E2 is a rectangular pattern to be sewn with tatami stitches of the same single color thread as the pattern E1. FIG. 4A illustrates specific example 2 where a pattern F to be sewn is virtually arranged relative to a workpiece C. The pattern F is to be sewn with six color threads. The pattern F is a monogram of the alphabet letter A on plants surrounded by a square frame. FIG. 5B illustrates specific example 3 where a pattern G to be sewn is virtually arranged relative to a workpiece C. The pattern G is generated based on a photograph of a swimming girl. In FIGS. 3A to 5E, a left-right direction and an up-down direction in each page correspond to the X direction and the Y direction of the movement mechanism 40 of the sewing machine 10. For simplicity of description purpose, the following collectively describes the main process regarding specific example 1, the main process regarding specific example 2, and the main process regarding specific example 3, which are executed at different times.

Figure 2:
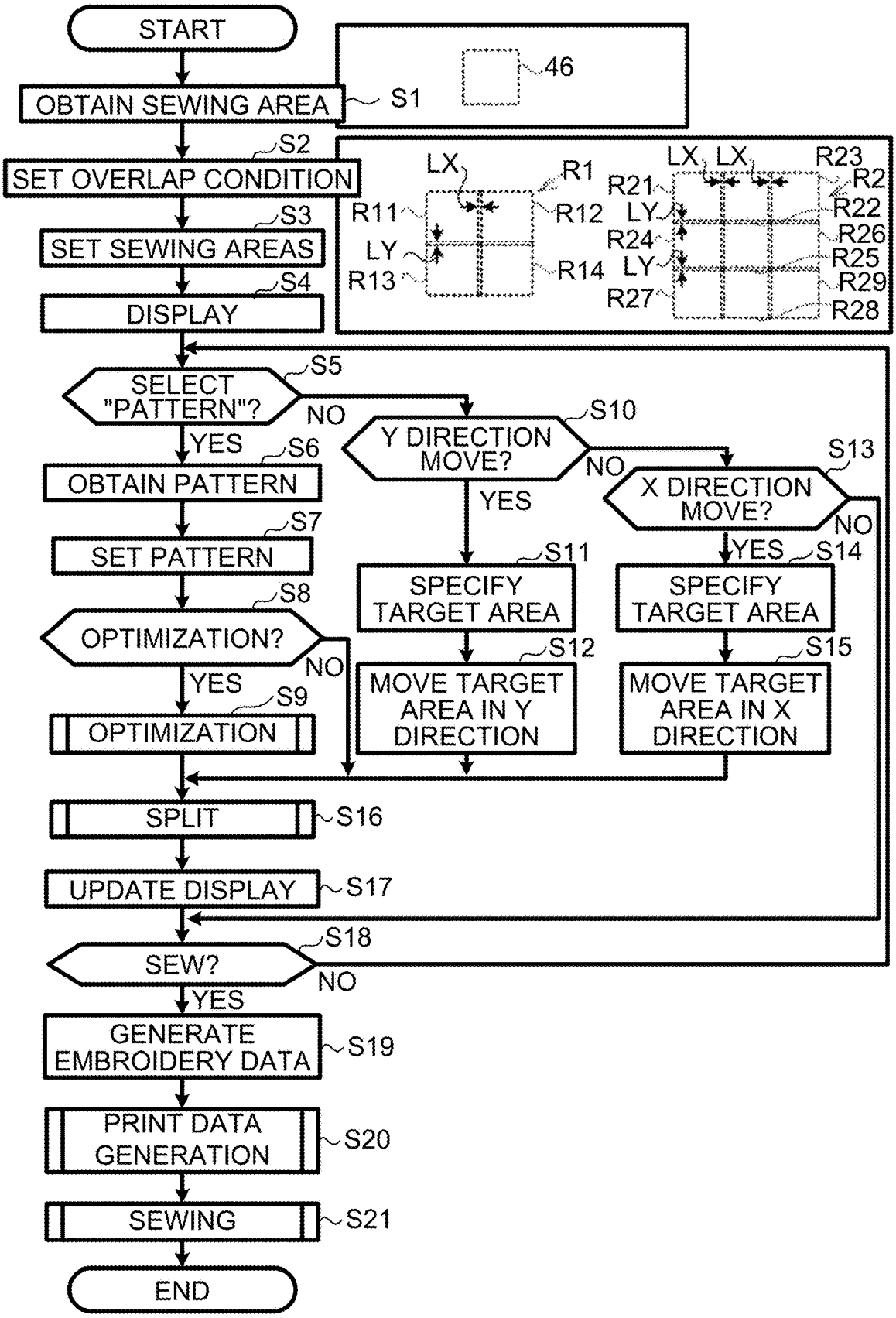
FIG. 2 is a flowchart of a main process to be executed in the sewing machine.

In the main process illustrated in FIG. 2, the CPU 61 obtains the size of sewing area to be set inside the embroidery hoop 45 based on the type of embroidery hoop 45 included in an instruction, and association between the type of embroidery hoop 45 and the size of sewing area which are stored in the flash memory 64 (S1). The CPU 61 may obtain the size input by the user as the size of sewing area. The CPU 61 may obtain the size of sewing area based on output values of the detector 36 and the above association. For example, the CPU 61 obtains the size of sewing area 46 illustrated in FIG. 2. The sewing area 46 is rectangular. Four sides of the sewing area 46 to be in the embroidery hoop 45 attached to the sewing machine 10 each extend in the X direction or Y direction of the movement mechanism 40.

The CPU 61 sets an overlap condition based on the instruction to start the main process (S2). The overlap condition includes a length (width) of an overlap area in an adjacent direction in which two adjacent sewing areas overlap, a position of an overlap range relative to the overlap area, and an overlap amount. For a pattern to be arranged in an area larger than a sewing area on a workpiece C, the CPU 61 of this example virtually sets a contiguous area in which the sewing areas are contiguous with each other such that a particular sewing area of the sewing areas overlaps an adjacent sewing area adjacent to the particular sewing area. The overlap area is an area where a sewing area and its adjacent sewing area overlap when sewing areas are virtually arranged on the workpiece C. The adjacent direction (moving direction) is a direction in which a line passing through the centers of the particular sewing area and the adjacent sewing area extends. The adjacent direction of this example includes directions in which sides of a sewing area extend, that is, the X direction and the Y direction. The overlap range is a range of an overlap of stitches with which a split sub pattern and its adjacent split sub pattern are to be blurredly connected. The overlap amount is a length in an adjacent direction of an overlap of stitches with which a split sub pattern and its adjacent sub pattern are to be blurredly connected. The overlap amount to be set to both split patterns may be set with the same value or a different value according to the moving direction or with an initial value.

The CPU 61 sets a virtual arrangement of sewing areas relative to the workpiece C (S3). The CPU 61 of this example sets a contiguous area based on the overlap condition set at S2. As illustrated in FIG. 2, for specific examples 1 and 2, a contiguous area R1 is virtually set in which two of four sewing areas R11 to R14 are arranged in each of the X direction and the Y direction. For specific examples 3, a contiguous area R2 is virtually set in which three of nine sewing areas R21 to R29 are arranged in each of the X direction and the Y direction. In specific examples 1 to 3, a width LX of an X-direction overlap area is equal to a width LY of a Y-direction overlap area. The width of an overlap area of this example is a length of the overlap area in a direction parallel to a short side of the overlap area. The width LX of the X-direction overlap area and the width LY of the Y-direction overlap may be different from each other. In a case where three or more sewing areas are contiguously arranged in the X or Y direction like specific example 3, the widths of overlap areas in the same direction may be identical to or different from each other. The CPU 61 sets a virtual arrangement of a contiguous area relative to the workpiece C to minimize the width of the overlap area in its acceptable range at S3. The acceptable range of the width of the overlap area and an initial value may be previously set or input by the user according to the size of sewing area and the type of pattern.

The CPU 61 fixes a position of a reference area of the sewing areas and displays a relative position of the sewing areas on the LCD 15 (S4). The reference area includes at least one of the sewing areas. The CPU 61 uses, as the reference area, an upper left sewing area, which is at an end in the X direction and the Y direction, of the sewing areas forming the contiguous area. For specific examples 1 and 2, the CPU 61 displays a screen 50 of FIG. 3A on the LCD 15. The screen 50 includes buttons 51 and 52, and a display area 53. The button 51 is selected to input an instruction to virtually arrange patterns on a workpiece C. The button 52 is selected to input an instruction to start sewing after embroidery data and print data are generated and output based on sewing areas arranged relative to the workpiece C and the patterns.

The display area 53 displays a contiguous area R1 and first objects X1 and Y1. The first objects X1 and Y1 indicate a relative position of each of the sewing areas. The first object X1 is a rectangular object indicating left ends of the sewing areas R12 and R14 relative to the reference area R11. The first object X1 is located on an imaginary line indicating the left ends of the sewing areas R12 and R14 and above the sewing area R12. The first object Y1 is a rectangular object indicating upper ends of the sewing areas R13 and R14 relative to the reference area R11. The first object Y1 is located on an imaginary line indicating the upper ends of the sewing areas R13 and R14 and closer to the left than the sewing area R12. For specific example 3, as illustrated in FIG. 5A, the display area 53 displays a contiguous area R2, and first objects X1, X2, Y1, and Y2. The first objects X1 and X2 are individually selectable to change a relative position in the X direction of the sewing areas. The first objects Y1 and Y2 are individually selectable to change a relative position in the Y direction of the sewing areas.

The CPU 61 determines whether the button 51 has been selected, that is, the CPU 61 has received an instruction to set a virtual arrangement of a pattern relative to a workpiece C (S5). For specific example 1, the user selects the button 51, draws objects to be sewn with a predetermined stitch type (e.g., tatami stitch), and then inputs an instruction to set a virtual arrangement of the drawn objects relative to the workpiece C. For specific example 2, the user selects the button 51, imports a pattern from the flash memory 64, and then inputs an instruction to set a virtual arrangement of the pattern relative to the workpiece C. For specific example 3, the user selects the button 51, imports a photograph from the flash memory 64, and coverts data of the photograph into embroidery data, and then inputs an instruction to set a virtual arrangement of patterns based on the converted embroidery data relative to the workpiece C.

If the CPU 61 has received an instruction to set a virtual arrangement of a pattern relative to a workpiece C (S5: YES), the CPU 61 obtains a pattern to be arranged (S6). For specific example 1, the CPU 61 obtains the pattern E. For specific example 2, the CPU 61 obtains the pattern F. For specific example 3, the CPU 61 obtains the pattern G. The CPU 61 sets a virtual arrangement of a pattern relative to the workpiece C (S7). The CPU 61 sets a virtual arrangement of a pattern relative to the workpiece C in accordance with the instruction from the user. The CPU 61 may automatically set a virtual arrangement of a pattern relative to the workpiece C. As illustrated in FIG. 3B, for specific example 1, the CPU 61 sets a virtual arrangement of the pattern E relative to the workpiece C. As illustrated in FIG. 4A, for specific example 2, the CPU 61 sets a virtual arrangement of the pattern F relative to the workpiece C. As illustrated in FIG. 5B, for specific example 3, the CPU 61 sets a virtual arrangement of the pattern G relative to the workpiece C.

The CPU 61 determines whether the CPU 61 has received an instruction to execute an optimization process at the start of the main process (S8). The optimization process is to set a virtual arrangement of sewing areas relative to the workpiece C based on the arrangement of patterns relative to the workpiece C and an optimization condition. The optimization condition of this example is selected from a first condition to minimize the number of splits of a sub pattern included in a pattern and a second condition to minimize the number of thread changes. A sub pattern is a portion of the pattern to be sewn from which it is delimited with cutting of thread. For specific example 3, the CPU 61 does not receive the instruction to execute the optimization process (S8: NO). The CPU 61 executes steps S16 and S17 which will be described later to display a relative position of sewing areas and an arrangement of a pattern relative to the sewing area on the LCD 15. If the CPU 61 has received the instruction to execute the optimization process (S8: YES), the CPU 61 executes the optimization process (S9). The optimization process will be described on the premise that the instruction to execute the optimization process includes the first condition for specific example 1 and the second condition for specific example 2.

Figure 6:
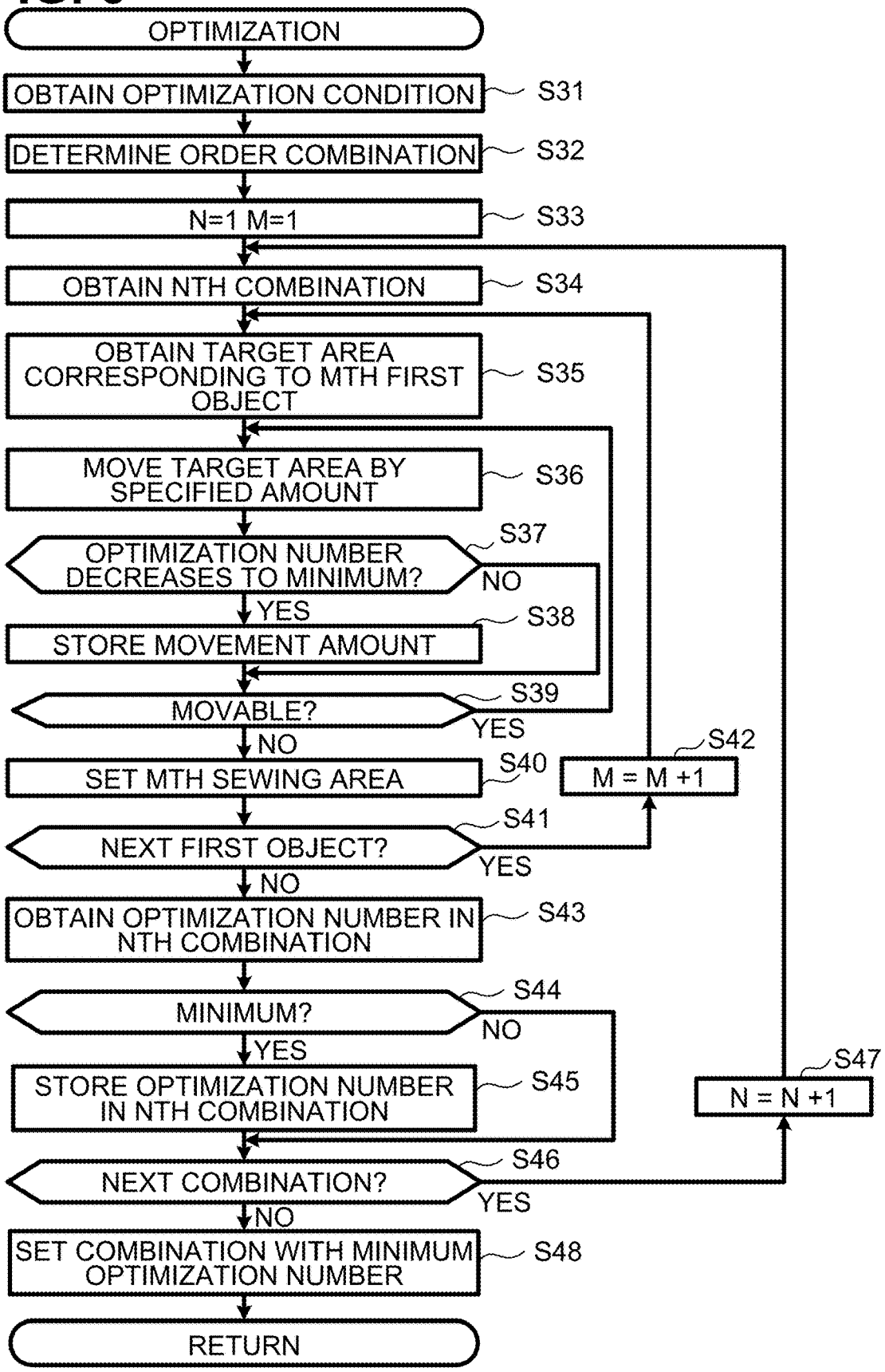
FIG. 6 is a flowchart of an optimization process to be executed in the main process of FIG. 2.
Figure 7:
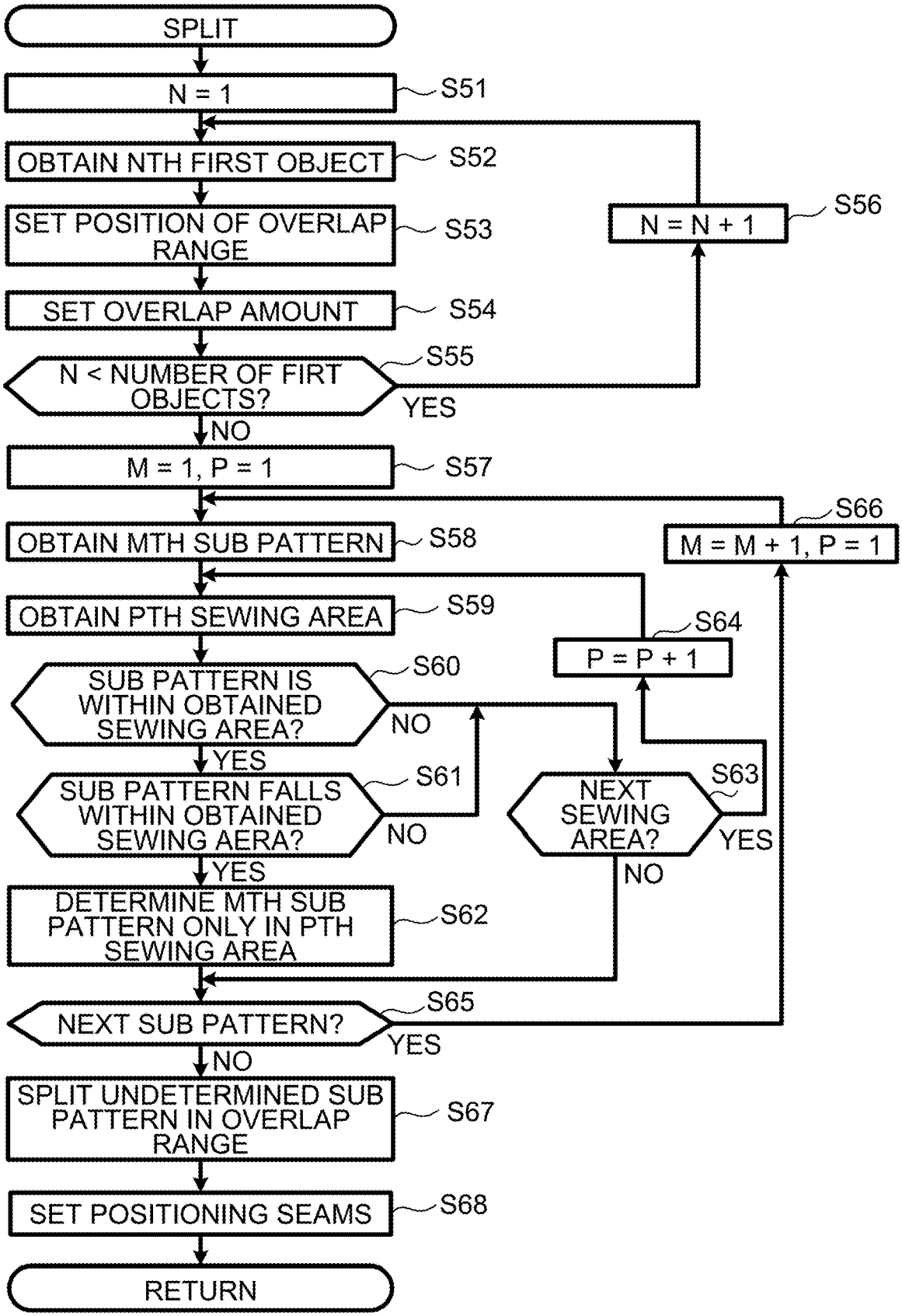
FIG. 7 is a flowchart of a split process to be executed in the main process of FIG. 2.
Figure 8:
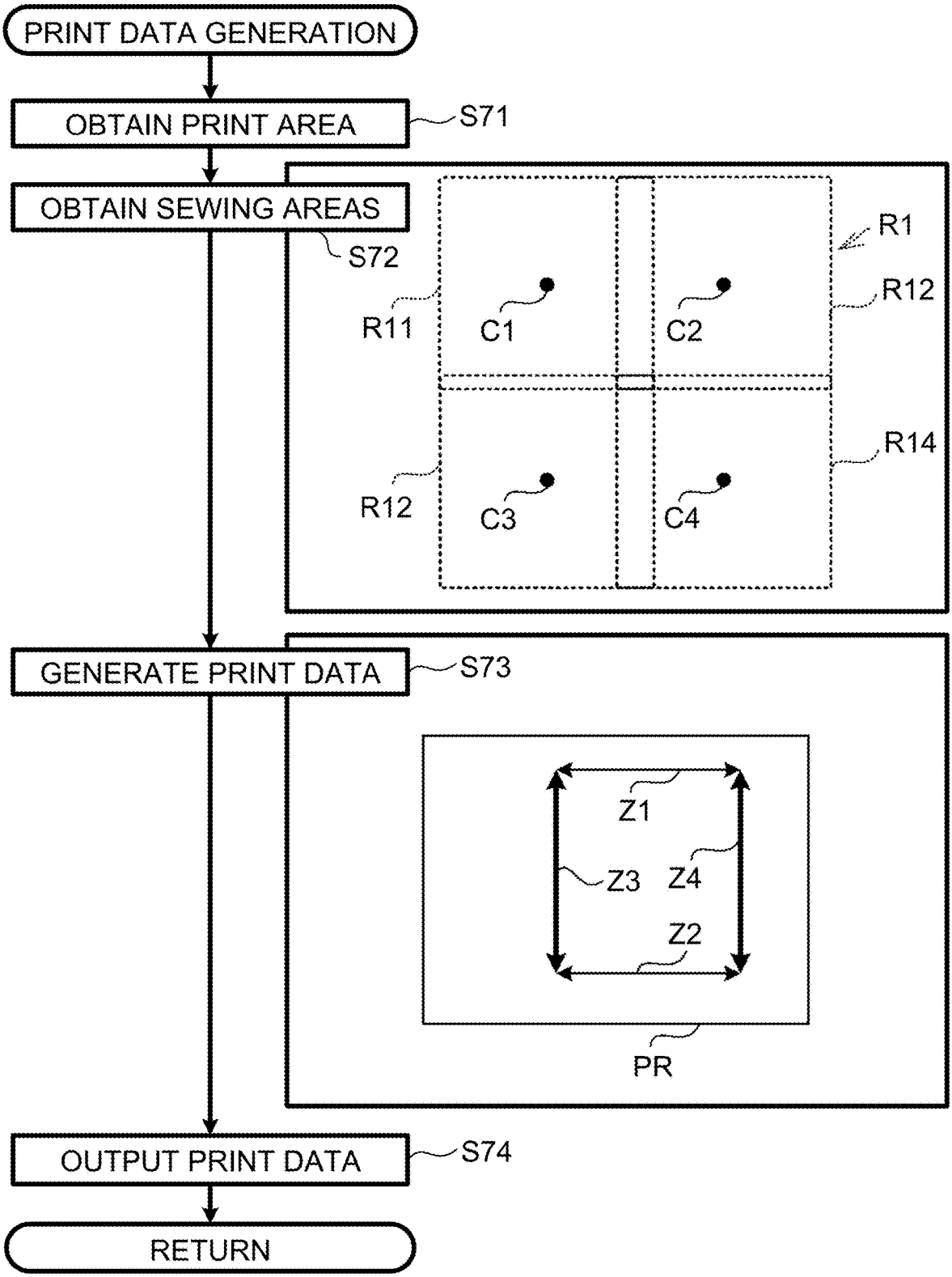
FIG. 8 is a flowchart of a print data generation process to be executed in the main process of FIG. 2.

In the optimization process illustrated in FIG. 6, the CPU 61 obtains an optimization condition (S31). For specific example 1, the CPU 61 obtains the first condition. For specific example 2, the CPU 61 obtains the second condition. The CPU 61 further obtains the number currently set in the optimization condition. As will be described later on in detail, if a sub pattern in the overlap area wholly falls within a sewing area, the CPU 61 associates the sub pattern in the overlap area with the sewing area without splitting. As illustrated in FIG. 3B, when the optimization condition is set to the first condition, the number set in the optimization condition is the number of splits. For specific example 1, the pattern E1 is located not wholly within a single sewing area but in both of the sewing areas R11 and R12. The pattern E2 is located not wholly within a single sewing area but in both of the sewing areas R13 and R14. The CPU 61 thus obtains 2 as the number of splits in specific example 1. When the optimization condition is set to the second condition, the number set in the optimization condition is the number of thread changes. As illustrated in FIG. 4A, specific example 2 shows the sewing areas R11 to R14 each in which six color threads are used. The CPU 1 obtains 20 as the number of thread changes.

The CPU 61 determines an order combination (S32). The order combination is a combination of an order to move first objects set in a contiguous area. For specific examples 1 and 2, two combinations are determined as indicated in a table 49. In a combination where a variable N is 1, the CPU 61 moves the first object X1 in the X direction, and then the first object Y1 in the Y direction. In a combination where the variable N is 2, the CPU 61 moves the first object Y1 in the Y direction, and then the first object X1 in the X direction.

The CPU 61 sets each of variables N and M to 1 (S33). The variable N is used to read a combination in the order combination determined at S32 in sequence. That is, the variable N refers to an Nth combination in the order combination. The variable M is used to read a first object in the Nth combination in sequence. That is, the variable M refers to an Mth first object to be moved in the Nth combination. The CPU 61 obtains the Nth combination in the combination determined at S32 (S34). The CPU 61 obtains a target area corresponding to the Mth first object to be moved of the Nth combination obtained at S34 (S35). The CPU 61 obtains, as a target area, the sewing areas R12 and R14 corresponding to the first object X1 of which moving order is 1 in the first combination. The first object X1 may correspond to one or more sewing areas. The CPU 61 moves the target area obtained at S35 by a specified amount (S36). The specified amount may be set as appropriate. The specified amount is smaller than, for example, an initial value for the width of the overlap area. The CPU 61 moves the sewing area corresponding to the first object relative to the reference area, thus changing a virtual relative position of sewing areas relative to a workpiece C. For specific examples 1 and 2, the CPU 61 moves the sewing areas R12 and R14 obtained at S35 leftward. In this case, the CPU 61 does not change a virtual arrangement of patterns and the sewing area R11, which is a reference area, relative to the workpiece C. The CPU 61 also does not change a virtual arrangement of the sewing area R13, which is not a target area, relative to the workpiece C.

The CPU 61 determines whether, in a case where the target area is moved at S36, the number set in the optimization condition is smaller than its minimum value (S37). When the variable N is 1, an initial value of the minimum value for the number set in the optimization process is a value calculated at S31. For specific example 1, if the first object X1 is moved to a position illustrated in FIG. 3C, the pattern E1 wholly falls within the sewing area R12, and thus the number of splits in the pattern E decreases from two to one (S37: YES). In this case, the CPU 61 stores the decreased number set in the optimization process and a movement amount of the first object X1 (S38). If the number set in the optimization process after moving is smaller than the minimum value (S37: NO), or subsequently to S38, the CPU 61 determines whether the Mth first object is movable further in a moving direction (S39). As described above, the overlap area is set with the acceptable range of its width. The CPU 61 accepts movement of the first object within which the overlap area is in the acceptable range. For example, in a case where the first object X1, which has been moved further to the left by a specified amount, reaches a position further to the right than the left end of the sewing area R11, the CPU 61 determines that the first object is movable (S39: YES), and returns to S36.

If the first object X1, which has been moved further in the moving direction by a specified amount, does not reach the position further to the right than the left end of the sewing area R11 (S39: NO), the CPU 61 sets the arrangement of the target area obtained at S35 such that the number set in the optimization process becomes the minimum value (S40). The CPU 61 determines whether the variable M is the last number (S41). If the variable M is not the last number (S41: YES), the CPU 61 increments the variable M by one (S42) and returns to S35. If the variable M is the last number (S41: NO), the CPU 61 obtains the minimum value for the number set in the optimization process in the Nth combination (S43). For the first combination of specific example 1, the number of splits in the arrangement illustrated in FIG. 3C becomes the minimum value. In this case, as the pattern E1 wholly falls within the sewing area R11, the number of splits is one. For the first combination of specific example 2, the number of thread changes in the arrangement illustrated in FIG. 4B becomes the minimum value. In this case, two thread colors are used in the sewing area R11, and six thread colors are used in each of the sewing areas R12 to R14. Thus, 16 is obtained as the minimum number of thread changes.

The CPU 61 determines whether the number set in the optimization process obtained at S43 is the minimum value (S44). If the number set in the optimization process obtained at S43 is the minimum value (S44: YES), the CPU 61 stores the number set in the optimization process in the Nth combination and a relative position of sewing areas relative to the workpiece C (S45). If the number set in the optimization process obtained at S43 is not the minimum value (S44: NO), or subsequently to S45, the CPU 61 determines whether there is a next combination (S46). If there is a next combination (S46: YES), the CPU 1 increments the variable N by one (S47) and returns to S34. If there is no more next combination (S46: NO), the CPU 61 sets the arrangement of the combination in which the number set in the optimization process becomes the minimum value at S45 (S48). The CPU 61 virtually sets a relative position of the sewing areas in the adjacent direction according to the number of sub patterns each falling within a corresponding one of the sewing areas. For specific example 1, the arrangement illustrated in FIG. 3C is set. The CPU 61 virtually sets a relative position of the sewing areas in the adjacent direction according to the number of thread changes to be executed within each of the sewing areas in accordance with color data of embroidery data. For specific example 2, the arrangement illustrated in FIG. 4B is set. The CPU 61 ends the optimization process and returns to the main process illustrated in FIG. 2.

In the main process in FIG. 2, if the CPU 61 has not received an instruction to set a virtual arrangement of a pattern relative to a workpiece C (S5: NO), the CPU 61 determines whether it has received a move instruction to move the first object Y1 or Y2 (S10). A user can input a move instruction to move a first object corresponding to any of sewing areas to change a virtual relative position of the sewing areas relative to the workpiece C. For specific example 3, the display area 53 illustrated in FIG. 5B is displayed on the LCD 15 at S17 which will be described later. To avoid setting an overlap area in a portion of the girl's face of the pattern G, the user selects the first object Y1 by operating the touch screen 26 while referring to the LCD 15, and inputs a move instruction to move the first object Y1 in the Y direction with a specified moving amount by dragging the selected first object Y1.

If the CPU 61 has received a move instruction to move the first object Y1 (S10: YES), the CPU 61 specifies one of the sewing areas to be moved as a target area (S11). If one or more of the sewing areas is located downstream of a particular sewing area corresponding to the first object in a moving direction to move the particular sewing area, the CPU 61 specifies, as a target area, the particular sewing area and at least one of the sewing areas located opposite, in the moving direction, to the reference area relative to the particular sewing area. If the CPU 61 has received the move instruction to move the first object Y1, the CPU 61 specifies, as a target area, sewing areas R24 to R26 corresponding to the first object Y1, and sewing areas R27 to R29 located opposite to the sewing area R21 which is a reference range. If the CPU 61 has received a move instruction to move the first object Y2, no sewing areas are located opposite to the sewing area R21 relative to the sewing areas R27 to R29 corresponding to the first object Y2. Thus, the CPU 61 specifies the sewing areas R27 to R29 corresponding to the first object Y2 as a target area.

Figure 5C:
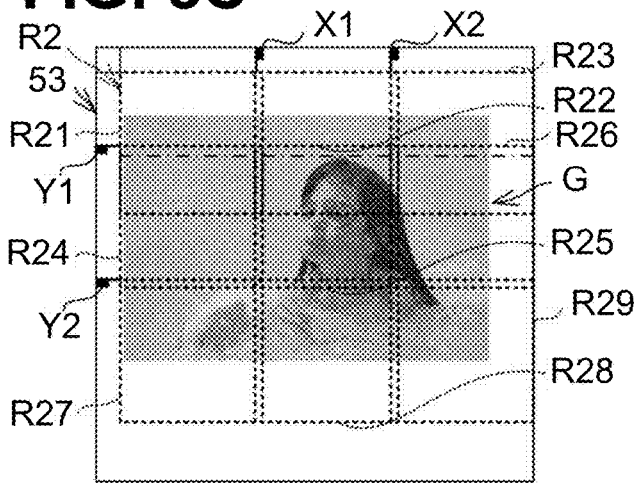
Figure 5D:
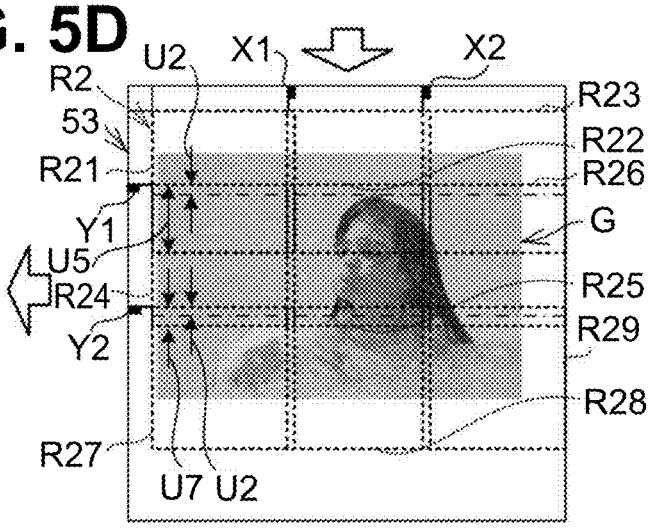
Figure 5E:
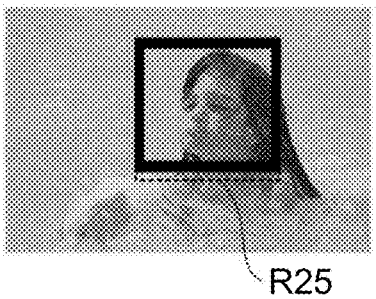

The CPU 61 moves the target area specified at S11 in the moving direction in response to the move instruction while maintaining intervals between the sewing areas in the moving direction, thereby changing the relative position of the sewing areas (S12). As illustrated in FIG. 5C, as the first object Y1 is moved upward, the sewing areas R24 to R29 are moved in the Y direction while an interval between a row of the sewing areas R24 to R26 and a row of the sewing areas R27 to R29 is maintained in the Y direction. When the first object Y1 is moved upward as illustrated in FIG. 5C and then the first object Y2 is moved upward as illustrated in FIG. 5D, the sewing areas R27 to R29 are moved in the Y direction. In this case, the sewing areas R21 and R24 have an overlap area with a width U5 in the Y direction, which is a different value from a width U7 of an overlap area between the sewing areas R24 and R27 in the Y direction. When the relative position of the sewing areas is changed, the CPU 61 updates the contents on the LCD 15, which are the relative position of the sewing areas and the arrangement of patterns corresponding to the sewing areas (S17) by moving the target area displayed on the LCD 15 by a specified moving amount.

If the CPU 61 has not received a move instruction to move the first object Y1 or Y2 (S10: NO), the CPU 61 determines whether it has received a move instruction to move the first object X1 or X2 (S13). If the CPU 61 has not received a move instruction to move the first object X1 or X2 (S13: NO), the CPU 61 executes step S18 which will be described later. If the CPU 61 has received a move instruction to move the first object X1 or X2 (S13: YES), as in the case with S11 and S12, the CPU 61 specifies a target area to be moved (S14), and moves the target area by a specified moving amount (S15).

The CPU 61 executes a split process subsequently to step S9, S12, or S15 (S16). In the split process, each of stitches with which a pattern is sewn is associated with any of sewing areas. The split process will be described using specific example 1. In the split process illustrated in FIG. 7, the CPU 61 sets one to a variable N (S51). The variable N is used to obtain a first object in sequence. For specific example 1 illustrated in FIGS. 3A to 3D, when the variable N is one, the CPU 61 obtains the first object X1, for example (S52). The CPU 61 sets a position of an overlap range relative to an overlap area defined by the first object X1 obtained at S52 (S53). The first object X1 defines left ends of the sewing areas R12 and R14. In FIG. 3C, the first object X1 defines an overlap area between the sewing areas R11 and R12 and an overlap area between the sewing areas R13 and R14 which are indicated with a width U1 in the X direction. The CPU 61 sets a position of an overlap range relative to an overlap area defined by the Nth first object based on an instruction, at the start of the main process, regarding a position of an overlap range relative to an overlap area. The position of the overlap range relative to the overlap area is specified, for example, based on a positional relationship between a representative point in the overlap area and a representative point in the overlap range in the moving direction. The CPU 61 sets a position where, for example, a left end of the overlap area aligns with a left end of the overlap range.

The CPU 61 sets an overlap amount relative to the overlap area defined by the first object X1 obtained at S52 (S54). The CPU 61 sets an overlap amount relative to an overlap area defined by the Nth first object based on an instruction, at the start of the main process, regarding an overlap amount relative to an overlap area. Through steps S53 and S54, the CPU 61 sets an overlap range indicated with a width U2 in the X direction in FIG. 3C, relative to an overlap area defined by the first object X1. The width U2 corresponds to an overlap amount. The CPU 61 determines whether the variable N is smaller than the number of first objects (S55). If the variable N is smaller than the number of first objects (S55: YES), the CPU 61 increments the variable N by one (S56) and returns to S52. If the variable N is greater than the number of first objects (S55: NO), the CPU 61 sets one to each of variables M and P (S57). The variable M is used to obtain a sub pattern in sequence. The variable P is used to obtain a sewing area in sequence.

The CPU 61 obtains an Mth sub pattern (S58). For specific example 1, for example, the CPU 61 obtains the pattern E1. The CPU 61 obtains a Pth sewing area (S59). For example, the CPU 61 obtains the sewing area R11. The CPU 61 determines whether the sub pattern obtained at S58 is located within the sewing area obtained at S59 (S60). If the sub pattern obtained at S58 is not located within the sewing area obtained at S59 (S60: NO), the CPU 61 executes step S63 which will be described later. The CPU 61 determines that the sub pattern E1 is located within the sewing area R11 based on, for example, a virtual arrangement of the pattern E1 relative to the workpiece C and a virtual arrangement of the sewing area R11 relative to the workpiece C (S60: YES). The CPU 61 determines whether the sub pattern obtained at S58 wholly falls within the sewing area obtained at S59 (S61). The CPU 61 determines that the sub pattern E1 does not wholly fall within the sewing area R11 or is located beyond the sewing area R11, for example, based on a virtual arrangement of the pattern E1 relative to the workpiece C and a virtual arrangement of the sewing area R11 relative to the workpiece C (S61: NO). The CPU 61 determines whether there is a next sewing area (S63).

If there is a next sewing area (S63: YES), the CPU 61 increments the variable P by one (S64) and returns to S59. If the sewing area R12 is obtained (S59), the CPU 61 determines that the pattern E1 is located within the sewing area R12 (S60: YES) and that the pattern E1 wholly falls within the sewing area R12 (S61: YES). In this case, the CPU 61 associates stitches with which the pattern E1 is sewn with the sewing area R12 such that all stitches for the pattern E1 are sewn within the sewing area R12 (S62). Through step S62, none of stitches for the pattern E1 is associated with the sewing area R11 although the pattern E1 is located in the sewing range R11. The CPU 61 determines whether there is a next sub pattern (S65). If there is a next sub pattern (S65: YES), the CPU 61 increments the variable M by one and sets one to the variable P (S66). The CPU 61 returns to S58 and repeats the above steps until it determines that there is no more next sub pattern.

If the pattern E2 is obtained (S58), determinations are made that the pattern E2 is not located in the sewing area R11 or R12 (S60: NO) and that the pattern E2 is in the sewing areas R13 and R14 but wholly does not fall within the sewing area R13 or R14 (S60: YES, S61: NO). In this case, none of stitches for the pattern E2 is associated with any of the sewing areas R11 to R14 at S62. The CPU 61 determines that there is no more next sub pattern (S65: NO), and splits a sub pattern which is not associated with any of the sewing areas at S62, in an overlap area, in a split direction orthogonal to an adjacent direction (S67). For example, the CPU 61 splits the pattern E2 in an overlap range indicated with the width U2 set in the sewing areas R13 and R14 over which the pattern E extends, in the Y direction orthogonal to the X direction. The pattern E2 is split into two patterns E3 and E4. Stitches for the pattern E3 are associated with the sewing area R13 and stitches for the pattern E4 are associated with the sewing area R14. The CPU 61 sets positioning seams (S68). The positioning seams are used to check whether a relative position of actual sewing areas relative to a workpiece C coincides with a virtual position of sewing areas relative to the workpiece C. The positioning seams are set in the same position in each overlap area between a sewing area and its adjacent sewing area. For example, the CPU 61 sets positioning seams D1 and D2 in the sewing areas R12 and R14, respectively, such as to be in the same position in an overlap area therebetween. Setting positioning seams may be eliminated as necessary. The CPU 61 ends the split process and returns to the main process illustrated in FIG. 2. For specific example 2 illustrated in FIG. 4B, for example, the pattern F is split into four sub patterns F1 to F4 on condition that the width U4 of an overlap area between the sewing areas R11 and R12 is set as an overlap amount applied to the sewing areas R11 and R12 and the width U3 of an overlap area between the sewing areas R11 and R13 is set as an overlap amount applied to the sewing areas R11 and R13. The sub patterns F1 to F4 are associated with the sewing areas R11 to R14, respectively. The sub pattern F1 is to be sewn with two color threads. The sub patterns F2 to F4 are each to be sewn with six color threads. For specific example 3, the first objects Y1 and Y2 are individually movable. In a sewing area R25 illustrated in FIG. 5E, a pattern is split in an overlap range indicated by black to remain a portion indicating the girl's face unsplit.

The CPU 61 updates the contents on the LCD 15 (S17). The CPU 61 reflects any of results including a changed relative position of a target sewing area relative to a workpiece C in relation to movement of the first object and association between a sewing area and stitches representing a pattern, which is set at S16. The CPU 61 determines whether the CPU 61 has received an instruction to start sewing (S18). When the button 52 is selected, the CPU 61 determines that the CPU 61 has received an instruction to start sewing. If the CPU 61 has not received the instruction to start sewing (S18: NO), the CPU 61 returns to S5. If the instruction to start sewing has been entered (S18: YES), the CPU 61 generates embroidery data including needle drop data indicating stitch positions in each of sewing areas based on association, which is set at S16, between a sewing area and stitches representing a pattern (S19). Embroidery data which is generated for every sewing area includes needle drop data, a sewing order, and color data. Embroidery data for a particular sewing area includes needle drop data indicating stitches for a portion of a pattern located within the particular sewing area. Stitches outside the particular sewing area is not included in the needle drop data. For specific example 1, the sewing area R12 and stitches for the sub pattern E1 which fall within the sewing area R12 are associated with each other at S16. The CPU 61 generates embroidery data to sew the sub pattern E1 in the sewing area R12 based on the association set at S16, and does not generate embroidery data to sew the sub pattern E1 in the sewing area R11 adjacent to the sewing area R12.

In the split process at S16, it is determined that the sub pattern E2 is located in the sewing range R13, but the sub pattern E2 does not wholly fall within the sewing area R13 or its adjacent sewing area R14. The sub pattern E2 is thus split into the sub patterns E3 and E4 in an overlap area between the sewing areas R13 and R14 in the Y direction. The CPU 61 generates embroidery data to sew, in the sewing area R13, stitches for the sub pattern E3 which fall within the sewing area R13. The CPU 61 generates embroidery data to sew, in the sewing area R14, stitches for the sub pattern E4 which are located beyond the sewing area R13 and wholly fall within the sewing area R14. The CPU 61 generates embroidery data such that the sub patterns E3 and E4 are overlapped and blurredly connected in the X direction. As a method of generating embroidery data where stitches are blurredly connected in an overlap area, a known manner disclosed in, for example, Japanese Laid-Open Patent Publication 2000-024350 may be used. The CPU 61 generates embroidery data by setting an overlap amount between the sub patterns E3 and E4 in their adjacent direction smaller than a length of the overlap area in their adjacent direction. In a case of splitting a sub pattern in an overlap area at S16, the CPU 61 splits, for example, the sub pattern E2 into the sub patterns E3 and E4 based on the position of the overlap range and the overlap amount to generate embroidery data.

The sewing order of each sewing area in embroidery data may be set as appropriate. For specific example 1, the CPU 61 generates embroidery data in which patterns E1, E4, and E3 are to be sewn in this order, as illustrated in FIG. 3D. When positioning seams are set at S68, the CPU 61 generates embroidery data including needle drop data for sewing the positioning seams. Specifically, embroidery data for the sewing area R12 may include needle drop data for sewing the positioning seam D1. Embroidery data for the sewing area R14 may include needle drop data for sewing the positioning seams D2 and D3. Embroidery data for the sewing area R13 may include needle drop data for sewing the positioning seam D4. For specific example 2, the CPU 61 generates embroidery data in which patterns F1, F2, F3, and F4 are to be sewn in this order, as illustrated in FIG. 4C. For specific example 3, although not illustrated, the CPU 61 generates embroidery data corresponding to each sewing area.

The CPU 61 executes a print data generation process (S20). In the print data generation process, print data for printing a second object indicating a relative position of sewing areas is generated. In the print data generation process illustrated in FIG. 8, the CPU 61 obtains the size of print area PR (S71). The CPU 61 may obtain the print area PR based on values input by the user or the size of sheet (e.g., A4 size specified by Japanese Industrial Standards, JIS) mountable in the printer 17 from the printer 17. The CPU 61 obtains an arrangement of sewing areas (S72). For specific example 1, the CPU 61 obtains an arrangement of a contiguous area R1 illustrated in FIG. 8. The CPU 61 specifies centers C1 to C4 of the sewing areas R11 to R14.

The CPU 61 generates print data for printing a second object indicating a relative position of sewing areas (S73). The second object may have any shape to indicate a relative position of the sewing areas. The second object of this example is indicated with double-headed arrows extending in the X direction and the Y direction, and each arrow points a center of a sewing area. The CPU 61 connects centers C1 to C4 of the sewing areas R11 to R14 specified at S72 with second objects Z1 and Z2 extending in the X direction and second objects Z3 and Z4 extending in the Y direction. The CPU 61 sets each of lengths in the X direction of the second objects Z1 and Z2 to a length of a segment connecting centers C1 and C2. The CPU 61 sets each of lengths in the Y direction of the second objects Z3 and Z4 to a length of a segment connecting centers C1 and C3. The second objects Z1 and Z2 may be distinguishable from the second objects Z3 and Z4 by line type, thickness, color, or another element. The CPU 61 outputs the print data generated at S73 as information indicating a relative position of sewing areas (S74). The CPU 61 sends the generated print data via the network 16 to the printer 17. The printer 17 prints the second objects Z1 to Z4 on a printing medium (such as a sheet of paper) in accordance with the received print data. The CPU 61 ends the print data generation process and returns to the main process illustrated in FIG. 2.

The user uses the printed printing medium to mark positions for sewing areas to be sewn sequentially on a workpiece C. For example, the user bores holes at points of double arrows of the second objects Z1 to Z4 in the printed printing medium. The user places the printed printing medium on the workpiece C in accordance with a virtual arrangement of sewing areas relative to the workpiece C, and inserts the point of a tailor chalk pen in each of the holes to mark positions of the holes on the workpiece C. The user positions the embroidery hoop 45 on the workpiece C such that, as for the sewing area R12 to be sewn, a segment connecting centers C1 and C2 extends in the X direction and the center C2 becomes a center of the sewing area R12.

Figure 9:
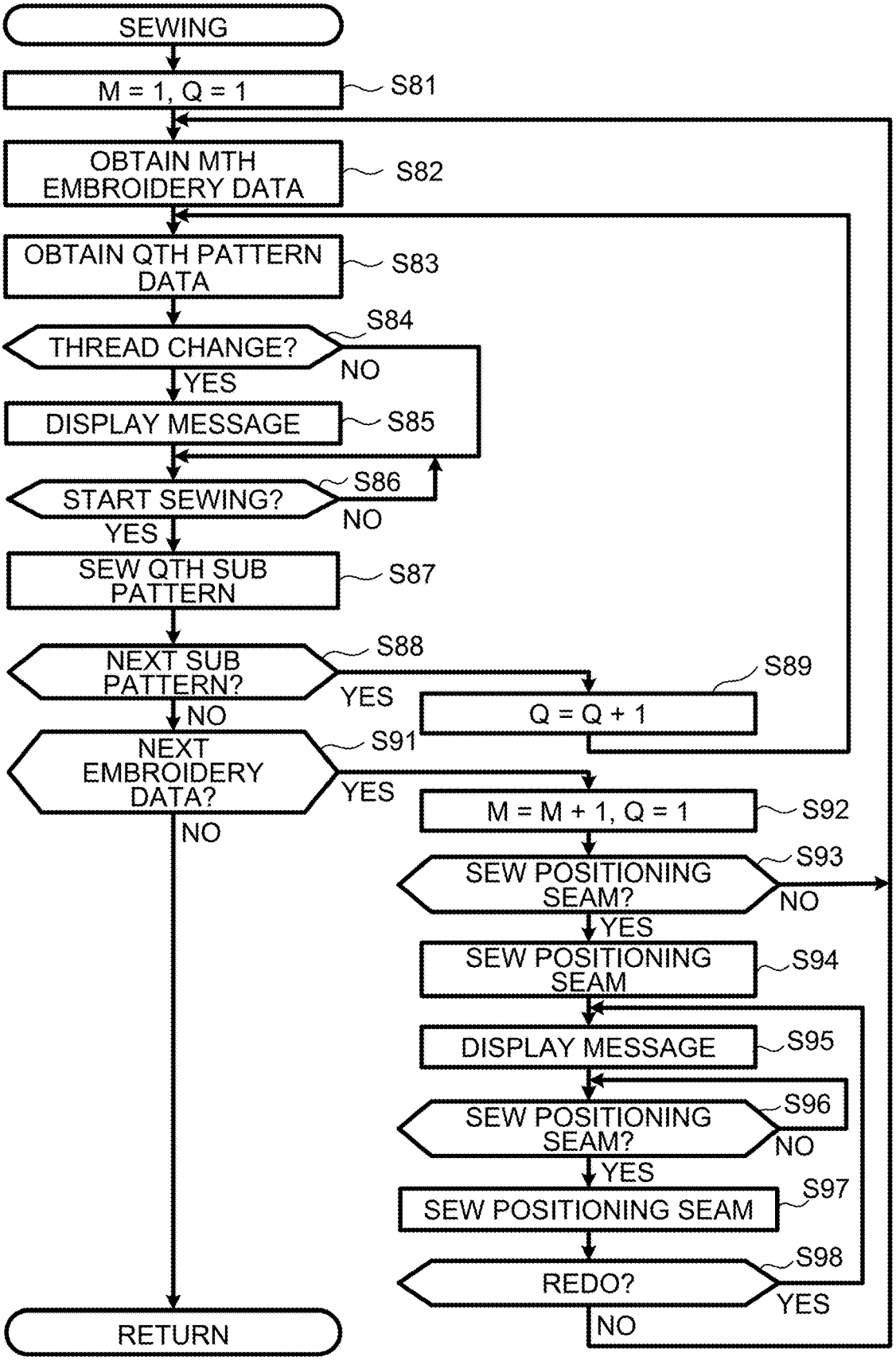
FIG. 9 is a flowchart of a sewing process to be executed in the main process of FIG. 2.

The CPU 61 executes a sewing process (S21). In the sewing process, stitches for a pattern is sewn on a workpiece C in accordance with embroidery data generated at S19. As illustrated in FIG. 9, the CPU 61 sets one to each of the variables M and Q (S81) and obtains an Mth embroidery data (S82). The CPU 61 obtains pattern data of a Qth sub pattern from the Mth embroidery data (S83). The pattern data refers to embroidery data for a sub pattern. If the CPU 61 determines that a thread change is necessary based on the pattern data of the Qth sub pattern obtained at S83 (S84: YES), the CPU 61 displays a message that a thread change is necessary on the LCD 15 (S85). If no thread change is necessary (S84: NO), or subsequently to step S85, the CPU 61 waits until it receives an instruction to start sewing (S86: NO). If the CPU 61 detects that the user has pressed the start/stop switch 29 (S86: YES), the CPU 61 controls the sewing machine 10 to sew the Qth sub pattern in accordance with the pattern data obtained at S83 (S87).

If the embroidery data obtained at S82 includes a sub pattern yet to be sewn (S88: YES), the CPU 61 increments the variable P by one (S89) and returns to S83. If there is no more sub pattern yet to be sewn (S88: NO) and there is embroidery data corresponding to a next sewing area (S91: YES), the CPU 61 increments the variable M by one and sets one to the variable P (S92). If a positioning seam is not sewn (S93: NO), the CPU 61 returns to S82. The CPU 61 may display a message prompting the user to change the position of the embroidery hoop 45 relative to the workpiece C in accordance with a virtual arrangement of a next sewing area relative to the workpiece C. If a positioning seam is sewn (S93: YES), the CPU 61 controls the sewing machine 10 to sew the positioning seam in accordance with the embroidery data (S94). The CPU 61 displays a message prompting the user to change the position of the embroidery hoop 45 relative to the workpiece C in accordance with a virtual arrangement of a next sewing area relative to the workpiece C (S95).

The user changes the position of the embroidery hoop 45 relative to the workpiece C in accordance with the virtual arrangement of the next sewing area relative to the workpiece C, and then presses the start/stop switch 29 to input an instruction to sew a positioning seam. The CPU 61 waits until the CPU 61 receives the instruction to sew the positioning seam (S96: NO). If the CPU 61 has received the instruction to sew the positioning seam (S96: YES), the CPU 61 controls the sewing machine 10 to sew the positioning seam (S97). The user checks whether the positioning seam sewn at S94 and the positioning seam sewn at S97 are located at the same position. If the positioning seam sewn at S94 and the positioning seam sewn at S97 are located at different positions, the user operates, for example, the touch screen 26 to input an instruction to redo sewing of positioning seams. If the CPU 61 has received the redo instruction within a specified time (S98: YES), the CPU 61 returns to S95. The user readjusts the position of the embroidery hoop 45 relative to the workpiece C in accordance with the virtual arrangement of the next sewing area relative to the workpiece C, and then inputs an instruction to redo sewing a positioning seam. If the CPU 61 has not received the redo instruction within a specified time, for example, five minutes (S98: NO), the CPU 61 returns to S82. If there is no more next embroidery data (S91: NO), the CPU 61 ends the sewing process and returns to the main process illustrated in FIG. 2. The CPU 61 ends the main process after S21. For specific example 1 illustrated in FIG. 3C, the positioning seams D1 to D4 to be sewn in the sewing process enables the user to check whether the position of the embroidery hoop 45 relative to the workpiece C coincides with the virtual arrangement of the sewing areas relative to the workpiece C before sewing a pattern corresponding to a next sewing area.

In the above embodiment, step S6 is an example of a step of obtaining a pattern of the disclosure. Step S1 is an example of a step of obtaining a size of a sewing area of the disclosure. Steps S3 and S48 are an example of a step of setting a virtual arrangement of a plurality of sewing areas of the disclosure. Step S7 is an example of a step of setting a virtual arrangement of the pattern of the disclosure. Steps S12 and S15 are an example of a step of changing of the disclosure. Step S19 is an example of a step of generating embroidery data of the disclosure. Step S2 is an example of a step of setting an overlap amount of the disclosure. Step S17 after step S7 is an example of a step of displaying of the disclosure. Step S17 after step S12 or S15 is an example of a step of updating of the disclosure. Steps S10 and S13 are an example of a step of obtaining an instruction of the disclosure. Step S74 is an example of a step of outputting of the disclosure. Step S73 is an example of a step of generating print data of the disclosure.

According to an embroidery data generation method of the above embodiment, the sewing machine 10 can change a relative position of sewing areas in a case where an embroidery pattern having a size larger than a sewing area is split into sub patterns each having a size smaller than the sewing area. The sewing machine 10 has a greater flexibility in setting an arrangement of sub patterns relative to sewing areas than a known sewing machine which cannot change a relative position of sewing areas. The sewing machine 10 can readily sew based on generated embroidery data.

The sewing machine 10 virtually sets a contiguous area in which the sewing areas are contiguous with each other such that a particular sewing area of the sewing areas overlaps an adjacent sewing area adjacent to the particular sewing area (S3). The sewing machine 10 changes a relative position of each of the sewing areas in an adjacent direction in which a line passing through a center of a sewing area of the sewing areas and a center of another sewing area adjacent to the sewing area extends (S12, S15). The sewing machine 10 can change a relative position of each of the sewing areas in a case where an embroidery pattern larger than a sewing area is split into sub patterns each smaller than the sewing area.

In a case where a pattern to be sewn includes sub patterns delimited with cutting of thread, the sewing machine 10 generates embroidery data to sew, in a particular sewing area, a sub pattern falling within the particular sewing area, and does not generate embroidery data to sew the sub pattern in an adjacent sewing area adjacent to the particular sewing area (S19). The sewing machine 10 splits a sub pattern, which is located in a particular sewing area of the sewing areas but wholly does not fall within the particular sewing area or its adjacent sewing area, in an overlap area in which the particular sewing area and the adjacent sewing area overlap, in a direction orthogonal to an adjacent direction. The sewing machine 10 generates embroidery data to sew, in the particular sewing area, a first split sub pattern which is split from the sub pattern and wholly falls within the particular sewing area, and generates embroidery data to sew, in the adjacent sewing area, a second split sub pattern which is split from the sub pattern and located beyond the particular sewing area and wholly falls within the adjacent sewing area (S19). The sewing machine 10 can prevent splitting of a sub pattern which wholly falls within one of the sewing areas forming a contiguous area, when generating embroidery data. An embroidery pattern is sewn based on the generated embroidery data with a beautiful finish more than an embroidery pattern having sub patterns split from a pattern which wholly falls within a sewing area.

The sewing machine 10 generates embroidery data such that two sub patterns split in an overlap area are blurredly connected with stitches for the sub patterns overlapping in the adjacent direction (S19). When a sub pattern is split, the sewing machine 10 can generate embroidery data having less conspicuous split positions.

The sewing machine 10 generates embroidery data by setting an overlap amount between two split sub patterns in the adjacent direction smaller than a length of the overlap area in the adjacent direction (S19). The sewing machine 10 can generate embroidery data to provide less conspicuous split positions when sewing split sub patterns having a relatively large overlap range.

The sewing machine 10 sets a position of an overlap range relative to an overlap area, and an overlap amount (S2). In a case of splitting a sub pattern in an overlap area, the sewing machine 10 splits the sub pattern into two sub patterns based on the position of the overlap range and the overlap amount set at S2 and then generates embroidery data (S16, S19). The sewing machine 10 can generate embroidery data such that two split sub patterns overlap each other by a specified amount at a specified position in a split area. The sewing machine 10 has a greater flexibility in setting an arrangement of sub patterns relative to sewing areas than a known sewing machine which cannot set an overlap range and an overlap amount. For specific example 3 illustrated in FIG. 5D, the sewing areas R21 and R24 have an overlap area with a width U5 in the Y direction, which is a different value from a width U7 of an overlap area between the sewing areas R24 and R27 in the Y direction. In this case, the sewing machine 10 can set an overlap amount in the Y direction to U2 in both the overlap area between the sewing areas R21 and R24 and the overlap area between the sewing areas R24 and R27. The sewing machine 10 thus reduces the possibility of spoiling an embroidery finishing caused by different overlap amounts in an embroidery pattern.

The sewing machine 10 virtually sets a relative position of the sewing areas in the adjacent direction according to the number of sub patterns each falling within a corresponding one of the sewing areas, the sub patterns being delimited with cutting of thread in a pattern to be sewn (S48). The sewing machine 10 can automatically set the relative position of the sewing areas to sew a pattern with a minimum number of split sub patterns. The sewing machine 10 thus saves the user from having to depend on trial and error methods to set the relative position of the sewing areas to sew a pattern with a minimum number of split sub patterns.

The sewing machine 10 virtually sets a relative position of the sewing areas in the adjacent direction according to the number of thread changes to be executed within each of the sewing areas in accordance with color data of embroidery data (S48). The sewing machine 10 can automatically set the relative position of the sewing areas using the number of thread changes in sewing in accordance with the embroidery data. The sewing machine 10 thus saves the user from having to depend on trial and error methods to set the relative position of the sewing areas in consideration of the number of thread changes in sewing in accordance with the embroidery data. The sewing machine 10 generates embroidery data in terms of the number of thread changes, thus enabling reduction of sewing time.

The sewing machine 10 fixes a position of a reference area of sewing areas on the LCD 15, and displays a relative position of the sewing areas and an arrangement of a pattern relative to the sewing areas on the LCD 15 (S17 after S7). When the relative position of the sewing areas is changed, the sewing machine 10 updates the contents displayed on the LCD 15, which are the relative position of the sewing areas and the arrangement of patterns corresponding to the sewing areas by moving a target area of the sewing areas relative to the reference area (S17 after S12 or S15). The sewing machine 10 can display a relative position of sewing areas and an arrangement of a pattern relative to the sewing areas. This enables the user to check a changed relative position of the sewing areas by looking at the LCD 15.

The sewing machine 10 displays a first object indicating a relative position of each of the sewing areas on the LCD 15 (S4, S17). The sewing machine 10 receives a move instruction to move a first object corresponding to one of the sewing areas (S10, S13). In accordance with the received move instruction, the sewing machine 10 moves sewing areas corresponding to the first object relative to the reference area, and thus changes a relative position of the sewing areas (S12, S15). The sewing machine 10 can change a relative position of sewing areas in accordance with an instruction to move a first object corresponding to any of the sewing areas in an adjacent direction. The user can move a desired one of the sewing areas by a desired amount by inputting a move instruction to move a first object corresponding to the desired one.

If one or more of the sewing areas is located downstream of a particular sewing area corresponding to the first object in a moving direction to move the particular sewing area, the sewing machine 10 moves a target area including the particular sewing area in the moving direction while maintaining intervals between the sewing areas in the moving direction, and thereby changing the relative position of the sewing areas (S12, S15). The CPU 61 specifies, as a target area, the particular sewing area corresponding to the first object and at least one of the sewing areas located opposite, in the moving direction, to the reference area relative to the particular sewing area corresponding to the first object. The sewing machine 10 can move the target area while maintaining intervals between the sewing areas in the adjacent direction. The sewing machine 10 saves the user from having to move a sewing area in accordance with movement of another sewing area.

The sewing machine 10 outputs information indicating a relative position of the sewing areas. Specifically, the sewing machine 10 generates print data for printing a second object indicating a relative position of the sewing areas (S73), and outputs the generated print data (S74). The sewing machine 10 can generate and output print data for printing a second object. The user can use the second object printed by the printer 17 in accordance with the print data to adjust the position of the second object to the relative position of the sewing areas, as a guide for positioning a work piece C to be held by the embroidery hoop 45. The sewing machine 10 can enhance convenience for the user setting the position of the embroidery hoop 45 relative to a workpiece C in association with the relative position of the sewing areas.

While a non-transitory computer-readable medium and an embroidery data generation method according to aspects of the disclosure are described in detail with reference to the specific embodiment thereof, these are merely examples, and various changes, arrangements and modifications may be made therein without departing from the spirit and scope of the disclosure. For example, the following modifications (A) to (C) may be made to the above embodiment.

(A) A non-transitory computer-readable medium may be a removable medium which is readable and writable, such as a magnetic disc, a magneto-optical disc, an optical disc, or a semiconductor memory. A non-transitory computer-readable medium may be a memory not intended to be portable, such as a hard disk drive or solid state drive (SSD) fixedly built in a computer that executes processing. The configuration of the apparatus that executes instructions stored in a non-transitory computer-readable medium may be modified as appropriate. Examples of the sewing machine 10 include an industrial sewing machine and a multi-needle sewing machine, which are capable of embroidering. A part or all of the main process except for sewing process may be executed in the apparatus 20. Configuration of the apparatus 20 may be modified as appropriate. The apparatus 20 may be a dedicated apparatus, or a portable terminal apparatus such as a smartphone or a tablet PC. The apparatus 20 may generate embroidery data based on which the sewing machine 10 may sew a pattern. The sewing machine 10 may eliminate the image sensor 35 and the detector 36.

(B) A program including instructions for the main process (refer to FIG. 2) executed at the sewing machine 10 may be stored in a storage device of the sewing machine 10 until the CPU 61 executes the program. Thus, a method for obtaining the program, a route through which the program is obtained, and a device that stores the program may be changed as appropriate. The program to be executed by the CPU 61 may be received from another apparatus via a cable or wireless communication, and may be stored in a storage device such as a flash memory. Examples of the other apparatus include a PC and a server connected via a network.

(C) The steps in the main process (FIG. 2) to be executed at the sewing machine 10 are not limited to being executed by the CPU 61, but some or all of the steps may be executed by another electronic device (e.g., an ASIC). In some embodiments, the steps of the main process may be decentrally executed by electronic devices (e.g., CPUs). The steps of the main process may be executed in a different order. A step may be omitted from or added to the main process. The scope of the disclosure includes such configuration that an operating system (OS) operating on the sewing machine 10 executes some or all of the steps of the main process based on a command/instruction from the CPU 61. For example, the following modifications (C-1) to (C-5) may be added to the main process.

Figure 10A:
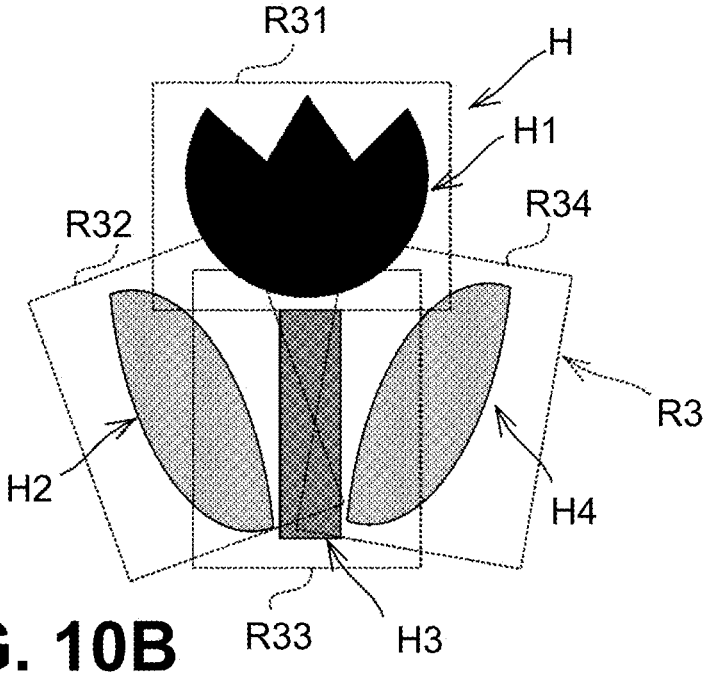
FIGS. 10A, 10B, and 10C each illustrate a virtual arrangement of patterns and sewing areas relative to a workpiece according to a modification of the disclosure.

(C-1) The sewing areas may be identical or different in size and shape. Sewing areas may be virtually arranged relative to a workpiece C as illustrated in FIG. 10A, for example. In the example illustrated in FIG. 10A, a pattern H representing a tulip includes sub patterns H1 to H4, and sewing areas R31 to R34 are set for the sub patterns H1 to H4. The sewing areas R31 to R34 are identical in size but different in orientation of their longitudinal direction. The sewing areas R31 to R34 form a contiguous area R3. The CPU 61 may achieve such an arrangement of the sewing areas by moving and rotating the sewing areas individually in the above embodiment.

Figure 10B:
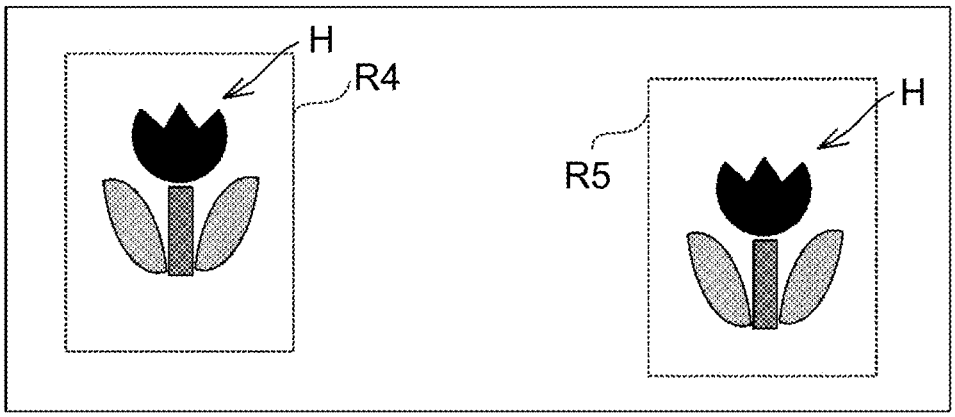
Figure 10C:
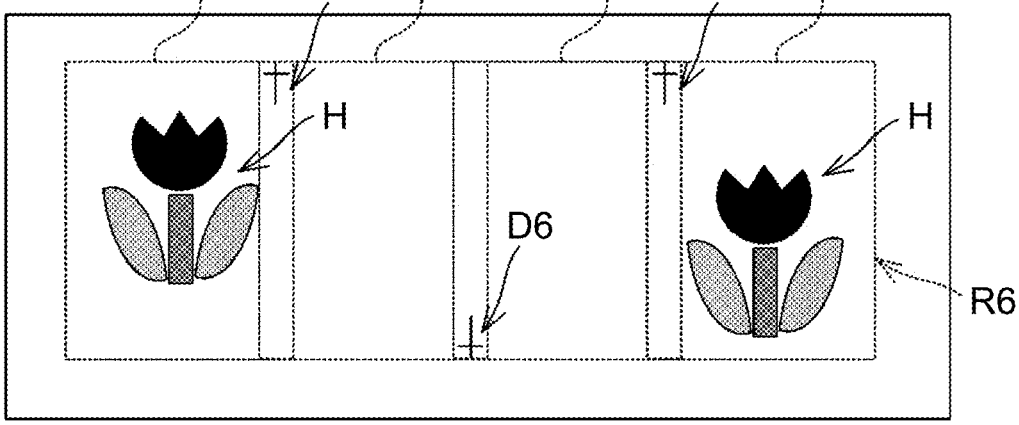

As an example of a virtual arrangement of sewing areas relative to a workpiece C, as illustrated in FIG. 10B, sewing areas R4 and R5 may be spaced from each other and may not form a contiguous area. In this case, the CPU 61 may output information indicating a relative position of sewing areas, such as a direction in which sewing areas are arranged, a center-to-center distance between adjacent sewing areas, and an offset amount from a center of a sewing area in the X or Y direction, by displaying, printing, or voice output. The user may use the outputted information to position the embroidery hoop 45 relative to the workpiece C in agreement with the virtual arrangement of the sewing areas R4 and R5. When the sewing areas are spaced from each other and do not form a contiguous area as illustrated in FIG. 10B, the CPU 61 may set a contiguous area R6 including sewing areas R61 to R64, as illustrated in FIG. 10C, in the optimization process. In this case, the CPU 61 may set positioning seams D5 to D7 at S68. This enables sewing stitches for at least one of a pattern and a positioning seam at each of the sewing areas R61 to R64. A process to output information indicating a relative position of sewing areas may be eliminated as necessary. A known method using the image sensor 35 may be used to adjust positions of the sewing areas R61 to R64.

(C-2) A pattern may be sewn with a single color thread and embroidery data may eliminate thread data. Embroidery data may be intended for a cross stitch pattern, for example. A method of splitting a sub pattern in an overlap area may be changed as appropriate. Patterns split in an overlap area may not be blurredly connected with stitches and may not overlap each other. At least one of the position of the overlap range and the overlap amount relative to the overlap area may be set with a specified value, set by the user, or rendered unchangeable. A pattern falling within a sewing area may be split in an overlap area. The reference area may be movable. Details of the positioning seams such as shape and position may be changed as necessary. An overlap range and an overlap amount between sewing areas may be changed in response to stitches for blurredly connecting sewing areas which are located along a line orthogonal to a moving direction. More specifically, the overlap range and the overlap amount may be set such that patterns are to be blurredly connected with a minimum amount. At least one of the overlap range and the overlap amount may be set in each of overlap areas on an individual basis.

(C-3) Details of the first and second objects, such as shape, size, color, and position, may be changed as appropriate. A virtual arrangement of sewing areas relative to the workpiece C may be set after a virtual arrangement of a pattern relative to the workpiece C is set. In this case, the CPU 61 may execute the optimization process after setting the virtual arrangement of the pattern relative to the workpiece C, thereby automatically setting a virtual relative position of the sewing areas relative to the workpiece C in accordance with the optimization condition. As the optimization condition, any of the first condition and second condition may be selectable, or another condition may be provided. Example of the other condition may include a minimum number of sewing areas, a minimum sized overlap range in a specified area (e.g., for specific example 3, a portion of the girl's face in FIG. 5), and a maximum duration of sewing.

(C-4) A method of inputting a move instruction may be changed as appropriate. For example, the user may drag to select a target area to be moved by a specified amount. Alternatively, the user may input a numeral value to specify a width of an overlap area. The CPU 61 may accept a movement in a specified direction only, such as the X direction or the Y direction. If a pattern is located beyond sewing areas after a target area is moved in accordance with the move instruction, the CPU 61 may display an error message, or add a new sewing area in accordance with a specified condition such that the pattern is in the sewing areas. The movable range of a particular sewing area may be set such that an overlap amount with its adjacent sewing area becomes equal to or greater than a minimum value and the particular sewing area does not overlap a sewing area which located two sewing areas away from the particular sewing area in a specified direction.

(C-5) At S17, setting results at S16 may not be displayed. The split process at S16 may be executed while embroidery data is generated. The display contents may be renewed after the split process (S16) and the embroidery data generation process (S19) are executed (S17). Steps S20 and S21 may be eliminated as necessary. For example, in a case where the main process is executed at the sewing machine 10, the sewing machine 10 may generate and store embroidery data in the flash memory 64 without sewing based on the embroidery data.

What is claimed is:

1. A non-transitory computer-readable medium storing computer-readable instructions, the computer-readable instructions, when executed by a computer, causing the computer to execute a process, the process comprising:

obtaining a pattern to be sewn on a workpiece by a sewing machine;

obtaining a size of a sewing area to be set inside an embroidery hoop attachable to the sewing machine;

setting a virtual arrangement of a plurality of the sewing areas relative to the workpiece;

setting a virtual arrangement of the pattern relative to the workpiece;

changing a relative position of the sewing areas; and generating embroidery data including needle drop data, the needle drop data representing a plurality of coordinates of needle drop points to form a plurality of stitches for the pattern located in each of the sewing areas in the relative position changed, wherein the setting of the virtual arrangement of the sewing areas virtually sets a contiguous area in which the sewing areas are contiguous with each other such that a particular sewing area of the sewing areas overlaps an adjacent sewing area adjacent to the particular sewing area, wherein the changing changes the relative position of each of the sewing areas in an adjacent direction in which a line passing through a center of the particular sewing area and a center of the adjacent sewing area extends, wherein, in a case where the pattern to be sewn includes a plurality of sub patterns delimited with cutting of thread, and each of the sub patterns is located in at least one of the sewing areas, wherein the generating generates embroidery data to sew, in the particular sewing area, a sub pattern of the sub patterns falling within the particular sewing area and does not generate embroidery data to sew the sub pattern in the adjacent sewing area, and wherein the generating splits the sub pattern, which is located in the particular sewing area but wholly does not fall within the particular sewing area and the adjacent sewing area, into a first split sub pattern and a second split sub pattern, in an overlap area in which the particular sewing area and the adjacent sewing area overlap, in a direction orthogonal to the adjacent direction, wherein the generating generates embroidery data to sew, in the particular sewing area, the first split sub pattern falling within the particular sewing area and embroidery data to sew, in the adjacent sewing area, the second split sub pattern located beyond the particular sewing area, wherein the generating sets an overlap amount between the first split sub pattern and the second split sub pattern smaller in the adjacent direction than a length of the overlap area, wherein the process further comprises setting the overlap amount and a position of an overlap range relative to the overlap area, and the overlap range is a range in which the first split sub pattern and the second split sub pattern overlap, and wherein the generating splits the sub pattern into the first split sub pattern and the second split sub pattern based on the overlap amount and the position of the overlap range.

2. The non-transitory computer-readable medium according to claim 1, wherein the generating blurredly connects the first split sub pattern and the second split sub pattern in the overlap area in the adjacent direction.

3. The non-transitory computer-readable medium according to claim 1, wherein the setting of the virtual arrangement of the sewing areas virtually sets the relative position of the sewing areas in the adjacent direction according to a number of the sub patterns each falling within a corresponding one of the sewing areas.

4. The non-transitory computer-readable medium according to claim 1, wherein the embroidery data includes color data representing a color of the stitches, and wherein the setting of the virtual arrangement of the sewing areas virtually sets the relative position of the sewing areas in the adjacent direction according to a number of thread changes to be executed within each of the sewing areas in accordance with the color data of the embroidery data.

5. The non-transitory computer-readable medium according to claim 1, wherein the process further comprises:

displaying the relative position of the sewing areas and an arrangement of the pattern relative to the sewing areas by fixing a reference area of the sewing areas on a display connectable with the computer; and updating the relative position of the sewing areas and the arrangement of the pattern relative to the sewing areas displayed on the display by moving a target area relative to the reference area, the target area including at least one of the sewing areas displayed on the display to be moved relative to the reference area, in a case where the changing changes the relative position of the sewing areas.

6. The non-transitory computer-readable medium according to claim 5, wherein the displaying and the updating display a first object indicating the relative position as to each of the sewing areas, wherein the process further comprises obtaining a move instruction to move the first object corresponding to any one of the sewing areas, and wherein the changing moves any one of the sewing areas corresponding to the first object, relative to the reference area, in accordance with the move instruction obtained to change the relative position of the sewing areas.

7. The non-transitory computer-readable medium according to claim 6, wherein, in a case where one or more of the sewing areas is located downstream of a particular sewing area of the sewing areas corresponding to the first object in a moving direction to move the particular sewing area, the changing specifies, as a target area, the particular sewing area corresponding to the first object and at least one of the sewing areas located opposite, in the moving direction, to the reference area relative to the particular sewing area corresponding to the first object, and moves the target area in the moving direction while maintaining intervals between the sewing areas in the moving direction, thereby changing the relative position of the sewing areas.

8. The non-transitory computer-readable medium according to claim 1, wherein the process further comprises outputting information indicating the relative position of the sewing areas.

9. The non-transitory computer-readable medium according to claim 8, wherein the process further comprises generating print data for printing a second object indicating the relative position of the sewing areas, and wherein the outputting outputs the print data generated.

10. A method of generating embroidery data comprising:

obtaining a pattern to be sewn on a workpiece by a sewing machine;

obtaining a size of a sewing area to be set inside an embroidery hoop attachable to the sewing machine;

setting a virtual arrangement of a plurality of the sewing areas relative to the workpiece;

setting a virtual arrangement of the pattern relative to the workpiece;

changing a relative position of the sewing areas; and generating embroidery data including needle drop data, the needle drop data representing a plurality of coordinates of needle drop points to form a plurality of stitches for the pattern located in each of the sewing areas in the relative position changed, wherein the setting of the virtual arrangement of the sewing areas virtually sets a contiguous area in which the sewing areas are contiguous with each other such that a particular sewing area of the sewing areas overlaps an adjacent sewing area adjacent to the particular sewing area, wherein the changing changes the relative position of each of the sewing areas in an adjacent direction in which a line passing through a center of the particular sewing area and a center of the adjacent sewing area extends, wherein, in a case where the pattern to be sewn includes a plurality of sub patterns delimited with cutting of thread, and each of the sub patterns is located in at least one of the sewing areas, wherein the generating generates embroidery data to sew, in the particular sewing area, a sub pattern of the sub patterns falling within the particular sewing area and does not generate embroidery data to sew the sub pattern in the adjacent sewing area, and wherein the generating splits the sub pattern, which is located in the particular sewing area but wholly does not fall within the particular sewing area and the adjacent sewing area, into a first split sub pattern and a second split sub pattern, in an overlap area in which the particular sewing area and the adjacent sewing area overlap, in a direction orthogonal to the adjacent direction, wherein the generating generates embroidery data to sew, in the particular sewing area, the first split sub pattern falling within the particular sewing area and embroidery data to sew, in the adjacent sewing area, the second split sub pattern located beyond the particular sewing area, wherein the generating sets an overlap amount between the first split sub pattern and the second split sub pattern smaller in the adjacent direction than a length of the overlap area, wherein the method further comprises setting the overlap amount and a position of an overlap range relative to the overlap area, and the overlap range is a range in which the first split sub pattern and the second split sub pattern overlap, and wherein the generating splits the sub pattern into the first split sub pattern and the second split sub pattern based on the overlap amount and the position of the overlap range.

* * * * *